US009270040B1

(12) United States Patent
Guanghua et al.

(10) Patent No.: US 9,270,040 B1
(45) Date of Patent: Feb. 23, 2016

(54) SYSTEMS AND METHODS FOR PROVIDING A SEAMLESS ELECTRICAL SIGNAL BETWEEN ELECTRICAL COMPONENTS

(71) Applicant: CISCO TECHNOLOGY, INC., San Jose, CA (US)

(72) Inventors: Xu Guanghua, Shanghai (CN); Zhu Feng, Shanghai (CN); Tian Huo, Shanghai (CN); Xing Wenzhong, Shanghai (CN); Yin Fengchun, Suzhou (CN)

(73) Assignee: CISCO TECHNOLOGY, INC., San Jose, CA (US)

( * ) Notice: Subject to any disclaimer, the term of this patent is extended or adjusted under 35 U.S.C. 154(b) by 0 days.

(21) Appl. No.: 14/499,046

(22) Filed: Sep. 26, 2014

(51) Int. Cl.

| | |
|---|---|
| ***H01R 13/70*** | (2006.01) |
| ***H01R 33/955*** | (2006.01) |
| ***H01R 12/70*** | (2011.01) |
| ***H01R 31/06*** | (2006.01) |

(52) U.S. Cl.
CPC ..... *H01R 12/7023* (2013.01); *H01R 31/065* (2013.01)

(58) Field of Classification Search
CPC .. H01R 2103/00; H01R 13/70; H01R 33/955; H01R 13/7032; H01R 13/7036
See application file for complete search history.

(56) References Cited

U.S. PATENT DOCUMENTS

| | | | | |
|---|---|---|---|---|
| 5,464,353 | A * | 11/1995 | Saijo | H01R 13/4362 439/188 |
| 5,470,243 | A | 11/1995 | Bendorf | |
| 5,562,486 | A * | 10/1996 | Saijo | H01R 13/4362 439/188 |
| 5,581,134 | A | 12/1996 | Romerein et al. | |
| 5,667,403 | A * | 9/1997 | Fukuda | H01R 13/641 439/188 |
| 5,692,916 | A | 12/1997 | Halasz | |
| 5,984,705 | A * | 11/1999 | Miyazaki | H01R 13/703 340/687 |
| 6,106,315 | A * | 8/2000 | Lalange | H01R 13/7032 200/51.1 |
| 6,162,078 | A * | 12/2000 | Chung | H01R 29/00 200/51.1 |
| 6,449,768 | B1 | 9/2002 | Oftedahl et al. | |
| 6,778,035 | B2 | 8/2004 | Eisenhart et al. | |
| 7,330,086 | B2 | 2/2008 | Martine | |
| 7,402,057 | B1 * | 7/2008 | Strang | H01R 13/7032 439/188 |
| 2011/0070762 | A1 | 3/2011 | Hiramatsu | |
| 2011/0141373 | A1 | 6/2011 | Gehringer et al. | |
| 2014/0057471 | A1 * | 2/2014 | Lee | H01R 13/7032 439/188 |

FOREIGN PATENT DOCUMENTS

| | | |
|---|---|---|
| JP | O8250225 | 9/1996 |

OTHER PUBLICATIONS

PCT Nov. 20, 2015 International Search Report and Written Opinion from International Application Serial No. PCT/US2015/052407; 20 pages.

* cited by examiner

*Primary Examiner* — Gary Paumen
(74) *Attorney, Agent, or Firm* — Patent Capital Group

(57) ABSTRACT

In an embodiment, an apparatus (e.g., for selectively contacting a plurality of electrical contacts on a printed circuit board (PCB)), comprises a support structure that, at least in part, borders a cavity in which to receive an electrical module; at least one beam comprising a first end supported by the support structure and a second end; a clip proximate the second end, wherein the clip is to retain a conductive connector; a raised portion located between the first end and the second end and extended into the cavity, wherein the raised portion is to facilitate flexing the beam to disconnect an electrical contact between the conductive connector and the plurality of electrical contacts upon insertion of the electrical module into the cavity. In some examples, the raised portion is to further facilitate establishing the electrical contact upon removal of the electrical module from the cavity.

20 Claims, 26 Drawing Sheets

300

SECTION B-B

300

SECTION A-A

SECTION C-C

400

SECTION D-D

400

SECTION E-E

1100

| | PAD Attenuator and Connector Setup | INSERTION LOSS (1102, 1104, 1106, 1108) | | | | INPUT RETURN LOSS (1110) | OUPUT RETURN LOSS (1112) |
|---|---|---|---|---|---|---|---|
| | **Frequency Start (MHz)** | **100** | **500** | **800** | **1200** | **5** | **5** |
| | **Frequency Stop (MHz)** | **100** | **500** | **800** | **1200** | **1250** | **1250** |
| 1114 | No PAD, without connector | -65.6 | -51.7 | -47.7 | -47.6 | 0.0 | 0.0 |
| 1116 | No PAD, with connector 0.6mm away from port | -58.2 | -44.3 | -40.6 | -39.8 | 0.0 | 0.0 |
| 1118 | 0dB PAD, PAD plugged without connector | 0.0 | -0.1 | -0.1 | -0.2 | -30.3 | -28.7 |
| 1120 | 0dB PAD, PAD plugged with connector 0.6mm away from port | 0.0 | -0.1 | -0.1 | -0.2 | -30.9 | -30.8 |
| 1122 | 5dB PAD, PAD plugged without connector | -5.0 | -5.1 | -5.2 | -5.4 | -22.9 | -24.6 |
| 1124 | 5dB PAD, PAD plugged with connector 0.6mm away from port | -5.0 | -5.1 | -5.2 | -5.4 | -22.8 | -23.3 |
| 1126 | 9dB PAD, PAD plugged without connector | -9.0 | -9.1 | -9.2 | -9.4 | -21.3 | -22.3 |
| 1128 | 9dB PAD, PAD plugged with connector 0.6mm away from port | -9.0 | -9.1 | -9.3 | -9.5 | -21.0 | -21.6 |
| 1130 | 13dB PAD, PAD plugged without connector | -13.0 | -13.1 | -13.2 | -13.3 | -24.3 | -25.1 |
| 1132 | 13dB PAD, PAD plugged with connector 0.6mm away from port | -13.0 | -13.1 | -13.2 | -13.4 | -24.6 | -23.3 |
| 1134 | 17dB PAD, PAD plugged without connector | -17.0 | -17.0 | -17.1 | -17.1 | -22.0 | -21.1 |
| 1136 | 17dB PAD, PAD plugged with connector 0.6mm away from port | -17.0 | -17.0 | -17.1 | -17.2 | -21.7 | -20.6 |

1101

FIG. 11

SYSTEMS AND METHODS FOR PROVIDING A SEAMLESS ELECTRICAL SIGNAL BETWEEN ELECTRICAL COMPONENTS

TECHNICAL FIELD

This disclosure relates in general to the field of communications and, more particularly, to providing seamless electrical signals between electrical components.

BACKGROUND

In an electrical system, an electrical module (e.g., an attenuator, an equalizer, an amplifier) can transmit signals to another component. However, an operator may need to remove the electrical module from the system for repairs, modifications, and/or replacement of the module. Replacing the electrical module often requires electrical disconnection of the electrical module and thus produces a loss in signal to any downstream component (e.g., a downstream user may experience an outage in service). In the example of cable television (CATV), the electrical module may pass signals from a CATV headend to a number of subscribers; thus, a loss in signal can affect many CATV customers. There remains a need for improved systems for replacing electrical modules in electrical systems, such as CATV systems.

BRIEF DESCRIPTION OF THE DRAWINGS

To provide a more complete understanding of the present disclosure and features and advantages thereof, reference is made to the following description, taken in conjunction with the accompanying figures, wherein like reference numerals represent like parts, in which:

FIGS. 11, 12, 13, 14, and 15 illustrate exemplary test data for various embodiments of the present disclosure.

DESCRIPTION OF EXAMPLE EMBODIMENTS OF THE DISCLOSURE

Overview

Figure 1A:
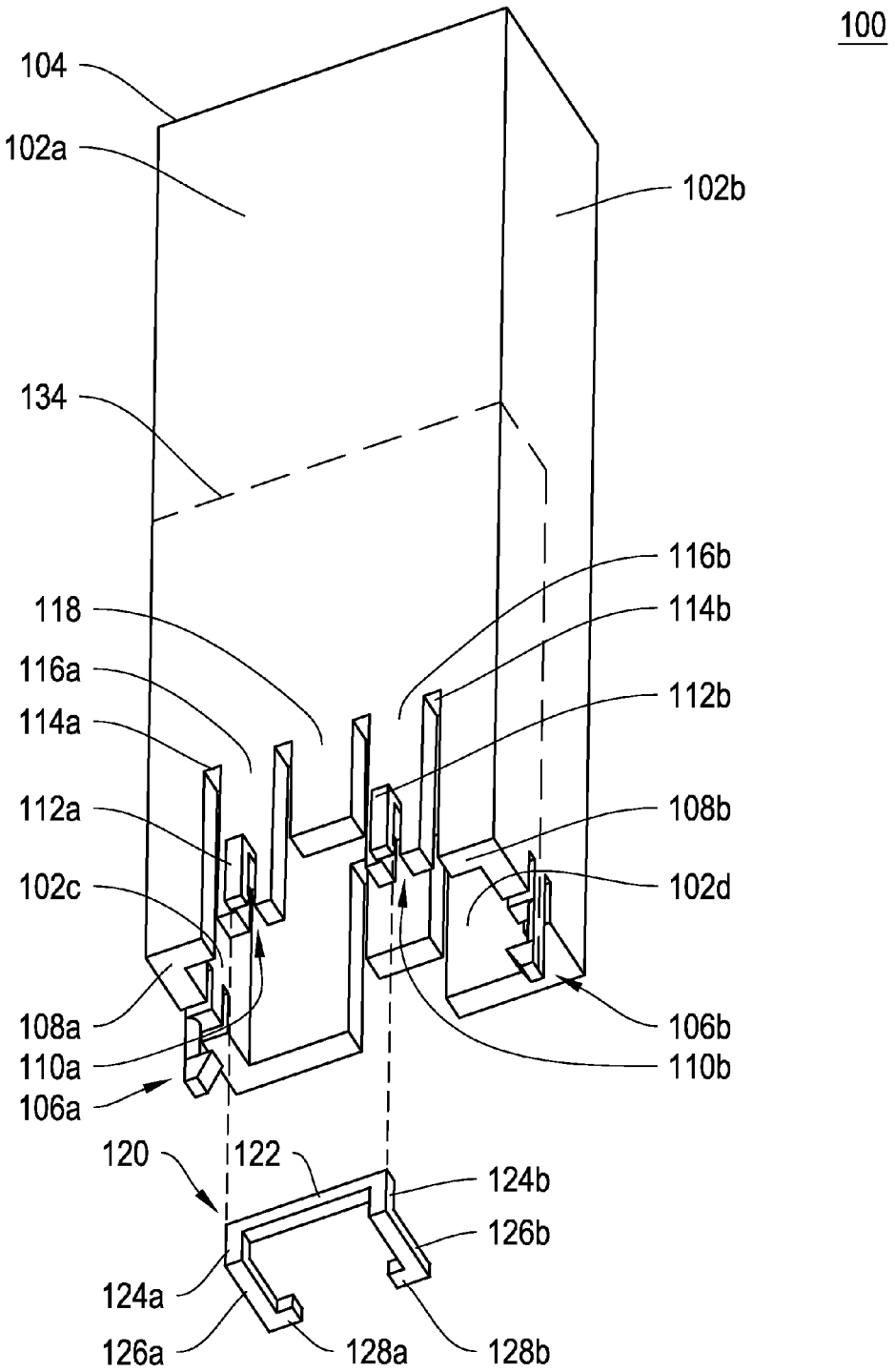
FIGS. 1A, 1B, and 1C illustrate three-dimensional isometric views of a guide device according to an embodiment of the present disclosure.

The following examples pertain to some embodiments of the disclosure.

Example 1 is an apparatus for selectively contacting a plurality of electrical contacts (e.g., ports) on a printed circuit board (PCB), the guide device comprising: a support structure that, at least in part, borders a cavity in which to receive an electrical module; at least one beam comprising; a first end supported by the support structure and a second end; a clip proximate the second end, wherein the clip is to retain a conductive connector; a raised portion located between the first end and the second end and extended into the cavity, wherein the raised portion is to facilitate flexing the beam to disconnect an electrical contact between the conductive connector and the plurality of electrical contacts upon insertion of the electrical module into the cavity.

In Example 2, the subject matter of Example 1 can optionally include: wherein the raised portion facilitates the flexing of the beam to disconnect the electrical contact only after an electrical pin of the electrical module contacts one of the plurality of electrical contacts during the insertion.

In Example 3, the subject matter of Examples 1 or 2 can optionally include: a guide device comprising a guide wall for securing to the circuit board, wherein the support structure is the guide wall.

In Example 4, the subject matter of any of Examples 1-3 can optionally include: wherein the guide wall comprises a third end located proximate to the PCB, a fourth end located distal to the PCB, and a medial end located between the third end and the fourth end, and wherein the first end is supported by the medial end of the guide wall.

In Example 5, the subject matter of any of Examples 1-2 can optionally include: wherein the support structure is a portion of the PCB.

In Example 6, the subject matter of any of Examples 1-5 can optionally include: wherein the plurality of electrical contacts comprises an input contact and an output contact, and wherein the electrical contact between the conductive connector and the plurality of electrical contacts comprises the conductive connector being in electrical contact simultaneously with the input contact and the output contact.

In Example 7, the subject matter of any of Examples 1-6 wherein the at least one beam is made from a plastic material, and wherein the conductive connector is made from an electrically conductive material.

In Example 8, the subject matter of any of Examples 1-7 wherein the electrical module is a module comprising a plurality of pins for connecting to one or more of the plurality of electrical contacts and/or an attenuator.

Example 9 is an apparatus for selectively contacting a plurality of electrical contacts on a printed circuit board (PCB), the apparatus comprising: a support structure that, at least in part, borders a cavity in which to receive an electrical module; at least one beam comprising: a first end supported by the support structure and a second end; a clip proximate the second end, wherein the clip is to retain a conductive connector; a raised portion located between the first end and the second end and extended into the cavity, wherein the raised portion is to facilitate unloading a force applied to the beam to establish an electrical contact between the conductive connector and the plurality of electrical contacts upon removal of the electrical module from the cavity.

In Example 10, the subject matter of Example 9 can optionally include: wherein the raised portion facilitates the unloading the force applied to the beam to establish the electrical contact before an electrical pin of the electrical module disconnects contact with one of the plurality of electrical contacts during the removal.

In Example 11, the subject matter of Examples 9 or 10 can optionally include: a guide device comprising a guide wall for securing to the circuit board, wherein the support structure is the guide wall.

In Example 12, the subject matter of any of Examples 9-11 can optionally include: wherein the guide wall comprises a third end located proximate to the PCB, a fourth end located distal to the PCB, and a medial end located between the third end and the fourth end, and wherein the first end is supported by the medial end of the guide wall.

In Example 13, the subject matter of any of Examples 9-10 can optionally include: wherein the support structure is a portion of the PCB.

In Example 14, the subject matter of any of Examples 9-13 can optionally include: wherein the plurality of electrical contacts comprises an input contact and an output contact, and wherein the electrical contact between the conductive connector and the plurality of electrical contacts comprises the conductive connector being in electrical contact simultaneously with the input contact and the output contact.

In Example 15, the subject matter of any of Examples 9-14 can optionally include: wherein the at least one beam is made from a plastic material, and wherein the conductive connector is made from an electrically conductive material.

In Example 16, the subject matter of any of Examples 9-15 can optionally include: wherein the electrical module is a module comprising a plurality of pins for connecting to one or more of the plurality of electrical contacts and/or an attenuator.

Example 17 is a system for selectively contacting a plurality of electrical contacts, the system comprising: a printed circuit board (PCB) comprising the plurality of electrical contacts; a guide device to removably connect to the PCB, the guide device comprising a guide wall for securing to the support substrate and that, at least in part, borders a cavity in which to receive the electrical module; an electrical module to removably insert into the cavity; at least one beam comprising: a first end supported by PCB and a second end; a clip proximate the second end, wherein the clip is to retain a conductive connector; a raised portion located between the first end and the second end and extended into the cavity, wherein the raised portion is to facilitate flexing the beam to disconnect an electrical contact between the conductive connector and the plurality of electrical contacts upon insertion of the electrical module into the cavity, and wherein the raised portion is to facilitate unloading a force applied to the beam to establish an electrical contact between the conductive connector and the plurality of electrical contacts upon removal of the electrical module from the cavity.

In Example 18, the subject matter of Example 17 can optionally include: wherein the raised portion facilitates the flexing of the beam to disconnect the electrical contact only after an electrical pin of the electrical module contacts one of the plurality of electrical contacts during the insertion, and wherein the raised portion facilitates the unloading the force applied to the beam to establish the electrical contact before an electrical pin of the electrical module disconnects contact with one of the plurality of electrical contacts during the removal and In Example 19, the subject matter of Examples 17 or 18 can optionally include: wherein the support structure is the guide wall.

In Example 20, the subject matter of any of Examples 17-19 can optionally include: wherein the guide wall comprises a third end located proximate to the PCB, a fourth end located distal to the PCB, and a medial end located between the third end and the fourth end, and wherein the first end is supported by the medial end of the guide wall.

In Example 21, the subject matter of any of Examples 17-18 can optionally include: wherein the support structure is a portion of the PCB.

In Example 22, the subject matter of any of Examples 17-21 can optionally include: wherein the plurality of electrical contacts comprises an input contact and an output contact, and wherein the electrical contact between the conductive connector and the plurality of electrical contacts comprises the conductive connector being in electrical contact simultaneously with the input contact and the output contact.

In Example 23, the subject matter of any of Examples 17-22 can optionally include: wherein the at least one beam is made from a plastic material, and wherein the conductive connector is made from an electrically conductive material (e.g., metal).

In Example 24, the subject matter of any of Examples 17-23 wherein the electrical module is a module comprising a plurality of pins for connecting to one or more of the plurality of electrical contacts and/or an attenuator.

In Example 25, the subject matter of Examples 1-16 can optionally include the apparatus being a computing device.

In Example 26, the subject matter of Examples 1-16 can optionally include the apparatus being a guide device.

Example 27 is a guide device for guiding an electrical module relative to a plurality of electrical contacts on a printed circuit board (PCB), the guide device comprising: a wall secured to the PCB and, at least in part, bordering a cavity in which to receive the electrical module, the wall having a first end located proximate to the PCB, a second end located distal to the PCB, and a medial end located between the first end and the second end; at least one beam extending from the medial end of the wall, the at least one beam comprising a first end and a second end; a clip to retain an electrically conductive connector, the clip located proximate the first end of the at least one beam and holding the electrically conductive connector in an electrical contact with the plurality of electrical contacts on the PCB; a raised portion extending into the cavity to facilitate flexing the beam upon insertion of the electrical module into the cavity, wherein the flexing of the beam disconnects the electrical contact between the electrically conductive connector and the plurality of electrical contacts on the PCB.

In Example 28, the subject matter of Example 27 can optionally include: wherein the raised portion facilitates the flexing of the beam to disconnect the electrical contact only after an electrical pin of the electrical module contacts one of the plurality of electrical contacts during the insertion.

Example Embodiments

Electrical systems may require adjustments of settings (e.g., as change signal tilt or signal power level) based on changing system requirements. Such adjustments can include, for example, replacing an electrical module (e.g., a module comprising a plurality of pins for connecting to one or more electrical contacts, an attenuator, an equalizer, an amplifier) in a node (e.g., motherboard, electrical or non-electrical control product). However, replacing the electrical module may disconnect an electrical connection between the module and a circuit to which the module is attached. For example, to extend the node to cover more subscribers, an operator may need to increase gain by removing a first pad attenuator from a printed circuit board (PCB) and replacing it with second pad attenuator that has a lower attenuation value than the first pad attenuator. In other examples, an operator may need to adjust an equalizer value by replacing one equalizer with another. Disconnecting the module from a node (e.g., a motherboard) will suddenly disrupt an electrical signal that provides service to a number of customers that are serviced by the node and/or module (e.g., an amplifier). In a CATV system, one node can serve hundreds of subscribers. Thus, replacing an electrical module (i.e., by first removing the module) has the potential to negatively impact service for a large number of subscribers.

In conventional systems, removing an electrical module results in loss of signal to subscribers serviced by the module (and/or node to which the module is connected) because no alternate electrical connection exists once the module is removed. Thus, replacing a module by removing it and replacing it with a new (or modified) module may result in loss of signal to the subscribers. There remains a need for improved systems for replacing electrical modules in electrical systems (e.g., replacing any three pin electrical module on a motherboard). For example, an existing challenge is to disconnect an electrical module without producing a loss in signal to the subscribers (e.g., CATV subscribers that are downstream (or upstream) of the electrical module). The systems and methods disclosed herein provide a solution to the aforementioned challenges by enabling a seamless electrical signal between components (e.g., seamless electrical signal between a three-pin electrical module and a motherboard/PCB). In one example, the seamless electrical signal is provided utilizing, among other things, a flexural element to facilitate selectively establishing an alternate electrical pathway between ports on a printed circuit board, e.g., while the electrical module is removed for replacement. Thus, an embodiment of the present disclosure always provides a pathway for an electrical signal (and therefore maintains the signal to subscribers) regardless of whether electrical module is inserted into or is removed from (i.e., is absent) an apparatus (e.g., a guide device utilized in a CATV system).

Figure 1B:
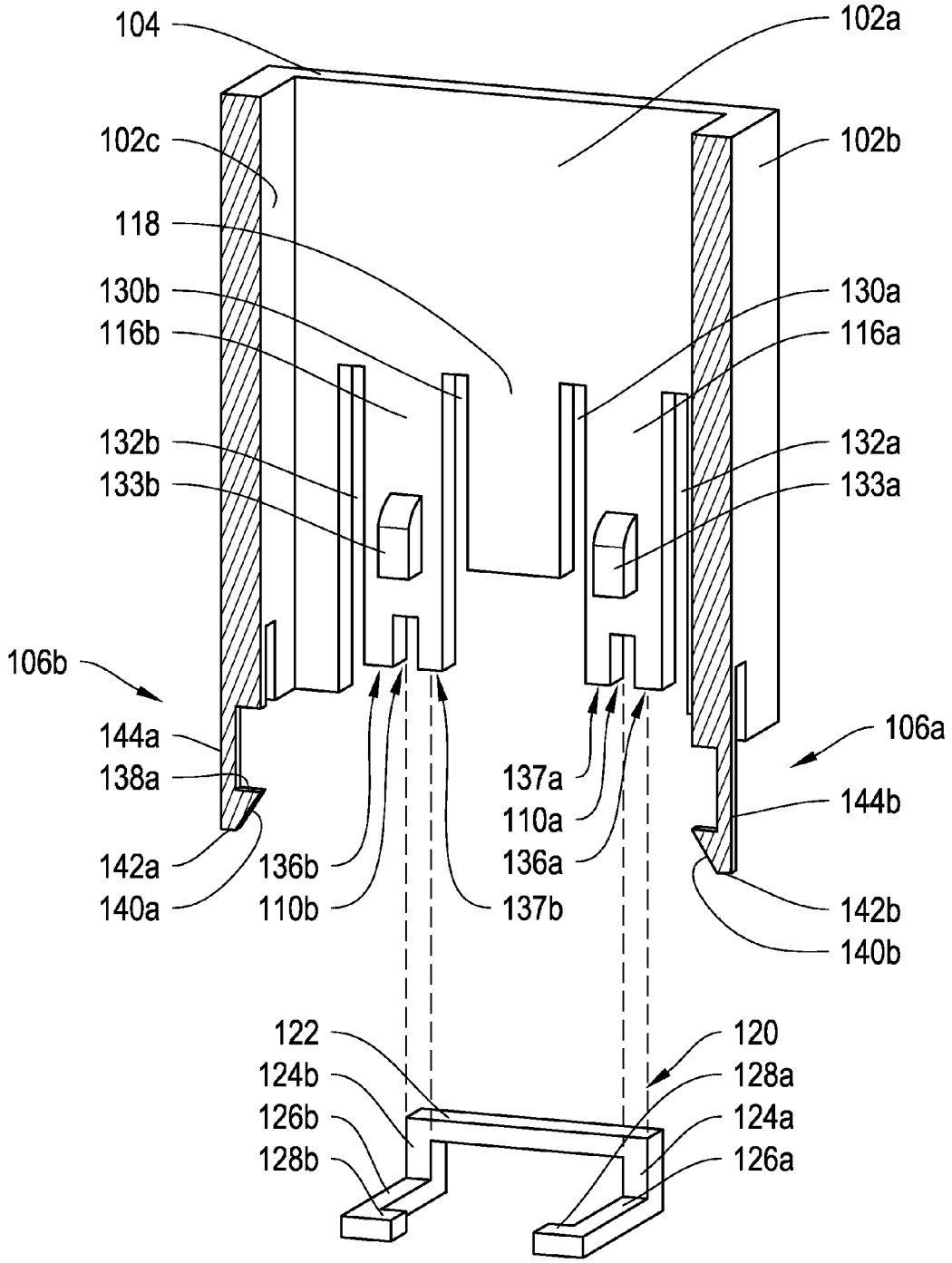
Figure 1C:
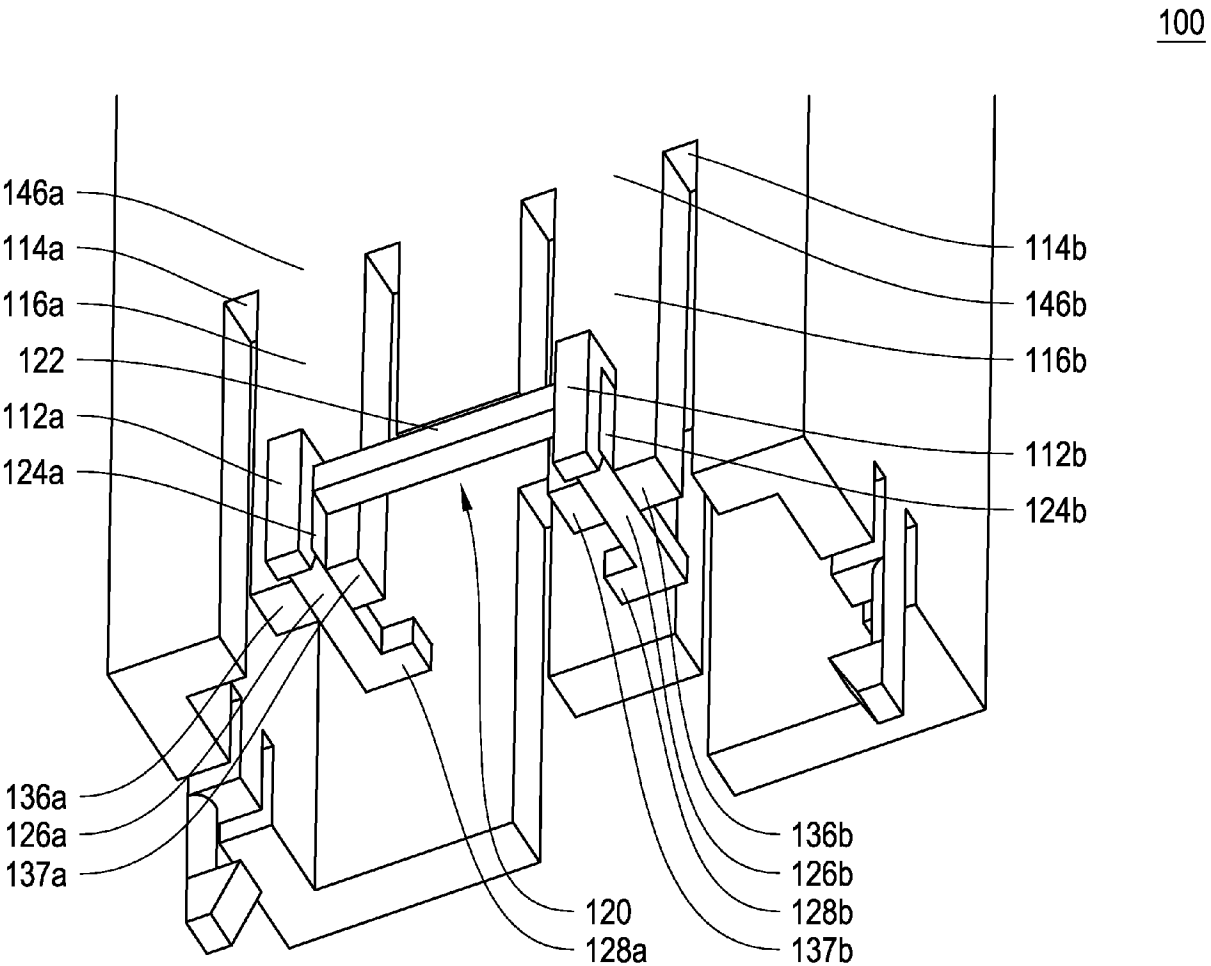

FIGS. 1A, 1B, and 1C illustrate three-dimensional isometric views of a guide device (guide device 100) according to an embodiment of the present disclosure. Turning to FIG. 1A, FIG. 1A illustrates guide device 100 including guide walls 102*a*, 102*b*, 102*c*, and 102*d*, attachment clips 106*a* and 106*b*, planar element 118, and flexural elements 116*a* and 116*b*. The guide walls 102*a*, 102*b*, 102*c*, and 102*d* form a hollow rectangular tube. Each of the guide walls is a support structure, e.g., for supporting other elements (e.g., flexural elements, beams, etc.). Each of the guide walls borders a cavity (e.g., the hollow region within the rectangular tube) in which to receive an object (e.g., any module comprising an input pin and an output pin for connecting to corresponding electrical contacts such as an attenuator and/or an equalizer, etc.). In an embodiment, the cavity is the hollow portion defined by interior faces of guide walls 102*a*, 102*b*, 102*c*, and 102*d*. Attachment clips 106*a* and 106*b* extend beyond an end of each of guide walls 102*b* and 102*c*. The guide walls 102 can be attached to another component, such as a circuit board (e.g., a printed circuit board (PCB)) using attachment clips 106*a* and 106*b*. When attached, the heads of attachment clips 106*a* and 106*b* extend though openings in the circuit board and a retention face of the head contacts a bottom surface of the circuit board. During the insertion, the heads of attachment clips 106*a* and 106*b* move away from one another causing a flexible portion of the attachment clip to deflect (or flex) until the head passes though the circuit board, at which point the clips return to an undeflected shape and the retaining face contacts the circuit board. Wall 102*a* has a first end 104, second end 108 (i.e., ends 108*a* and 108*b*), and medial end 114 (i.e., ends 114*a* and 114*b*). When the guide device is secured to the circuit board, the second end 108 is located adjacent the circuit board (e.g., a bottom end of the board), and the first end 104 is located distal the circuit board (e.g., a top end).

Each of planar element 118 and flexural elements 116*a* and 116*b* are supported by a support structure, which in this case is guide wall 102*a*. Wall 102*a* has a first end 104, second end 108 (i.e., ends 108*a* and 108*b*), and medial end 114 (i.e., ends 114*a* and 114*b*). First end 104 and second end 108 are on opposite extreme ends of the wall 102*a*. The medial end 114 is located between first end 104 and second end 108 along wall 102*a*. Flexural elements 116*a*, 116*b*, and 118 extend from (and are supported by) medial end 114 of wall 102*a*. Each of elements 116*a*, 116*b*, and 118 are supported by wall 102*a* only at one end while an opposite end is unsupported; thus each of elements 116*a*, 116*b*, and 118 are cantilevered from wall 102*a*. Elements 116*a*, 116*b*, and 118 do not extend beyond end 108 of wall 102*a*.

Each of flexural elements 116*a* and 116*b* is a cantilevered beam to facilitate selectively moving an electrically conductive connector 120 into contact with one or more electrical components (e.g., electrical ports on a circuit board). Beams 116*a* and 116*b* are substantially identical to one another except for their placement along wall 102*a*. Each of beams 116*a* and 116*b* include a first end, which is supported by the wall 102*a* (i.e., at media end 114), and a second end, which cantilevers away from the medial end 114*a*. The second end of each of beams 116*a* and 116*b* (which is unsupported, or cantilevered) includes a respective gaps 110*a* and 110*b*, and a respective clips 112*a* and 112*b*. Each of clips 112*a* and 112*b* are proximate the second end of beams 116*a* and 116*b*, respectively. Each clip is to retain a conductive connector (e.g., connector 120). Forked ends 136*a* and 137*a* (labeled in FIGS. 1B and 1C) border gap 110*a* on the beam 116*a*. Forked ends 136*b* and 137*b* border gap 110*b* on the beam 116*b*. Together, the clip 112*a* and the gap 110*a* are to retain a portion of the conductive connector 120 at the second end of the beam 116*a*. Likewise, the clip 112*b* and the gap 110*b* are to retain a portion of the conductive connector 120 at the second end of the beam 116*b*. In operation, conductive connector 120 can be removably attached to each of beams 116*a* and 116*b* and retained by clips 112 and gaps 110 on each of the beams respectively. In one example, the conductive connector 120 is slidably received by clips 112 and gaps 110, which hold the connector in place at the free ends of beams 116*a* and 116*b*. Each of beams 116*a* and 116*b* is shown in an undeflected state wherein the beam is coplanar with the wall. Moreover, in this undeflected state, a front face of each of the beams is coplanar with a front face of the guide wall and a back face of each of the beams is coplanar with a back face of the guide wall. Because the conductive connector 120 is coupled to the free ends of beams 116*a* and 116*b*, any movement of the free ends (e.g., due to deflection outward away from the cavity) causes movement of the connector, thereby allowing an electrical contact between the connector and one or more electrical components to be selectively connected (and/or selectively disconnected).

Conductive connector 120 is an electrically conductive connector for selectively contacting one or more electrical components (e.g., ports on a circuit board) thereby establishing or disconnecting electrical contact therewith. Conductive connector 120 has a brace portion 122, vertical portions 124*a* and 124*b*, arms 126*a* and 126*b*, and contact portions 128*a* and 128*b*. When the connector 120 is coupled to the beam 116*a*, the vertical portion 124*a* rests within clip 112*a* and the arm 126*a* rests within gap 110*a*. Likewise, when the connector 120 is coupled to the beam 116*b*, the vertical portion 124*b* rests within clip 112*b* and the arm 126*b* rests within gap 110*b*. When the connector 120 is simultaneously coupled to both beams 116*a* and 116*b* and the beams are undeflected, then the arms 126*a* and 126*b* and contact portions 128*a* and 128*b* extend into the cavity within the guide walls 102. When the connector 120 is simultaneously coupled to both beams 116*a* and 116*b* and the beams are flexed outward away from the cavity (e.g., deflected outward), then the arms 126*a* and 126*b* and contact portions 128*a* and 128*b* retreat away from the cavity within the guide walls 102. For example, when the beams are in an undeflected state, the contact portions 128*a* and 128*b* may extend into the cavity a length of X millimeters (mm). However, when the beams are in a deflected state, the contact portions may extend into the cavity a length of Y mm, where Y mm is less than X mm. In some examples, the change in location of the contact portions (i.e., the change from X mm depth into the cavity to Y mm depth into the cavity) disconnects an electrical contact between the contact portions and one or more ports on a circuit board (e.g., a printed circuit board). In an embodiment, the conductive connector 120 is made from metal (e.g., gold, copper) or any electrically conductive material.

In this example, only guide wall 102*a* includes flexural elements (e.g., 116*a* and 116*b*) to selectively connect or disconnect contact with an electrical component. In other examples, guide walls 102*b*, 102*c*, or 102*d* may also include all or some of the components as described with respect to guide wall 102*a*. For example, guide wall 102*b* may include another set of flexural elements, in addition to those present on wall 102*a*. In other examples, guide wall 102*b* may be the only wall that includes flexural elements (while the other walls do not include flexural elements). In this example, two flexural elements are present. This example may be modified to utilize only one flexural element (e.g., centered on wall 102*a*) or one or more flexural elements (e.g., a number of flexural elements evenly spaced along wall 102*a*).

FIG. 1A illustrates, among other things, an exterior portion of guide device 100 and exterior faces of several components of the guide device. Turning to FIG. 1B, FIG. 1B illustrates, among other things, an interior portion of guide device 100 and interior faces of several components of the guide device (e.g., an interior face of each of elements 116*a*, 116*b*, and 118).

FIG. 1B illustrates a portion of guide device 100 in an isometric view of cut along section line 134, which is illustrated in FIG. 1A. Beams 116*a* and 116*b* include respective gaps 110*a* and 110*b*, are flanked on either side by forked ends 136 and 137. Each of an interior surface of wall 102*a* and interior surfaces of beams 116*a* and 116*b* are coplanar with one another. The interior faces of beams 116*a* and 116*b* include raised portions 133*a* and 133*b*, respectively. The raised portions 133*a* and 133*b* are located between the first end of the beam (which is supported by the wall) and a second end (which is free and unsupported). The raised portion includes an angled face and several vertical portions. The raised portions 133*a* and 133*b* are raised with respect to the inner surface of beams 116*a* and 116*b* (as well as with respect to wall 102*a*), and thus extend into the cavity defied by the inner faces of walls 102*a*, 102*b*, 102*c*, and 102*d*. Insertion of an object into the cavity causes the raised portions to be displaced out of the cavity. The raised portions 133*a* and 133*b* facilitate flexing the beams 116*a* and 116*b*, respectively, upon insertion of an object into the cavity.

In operation, flexural elements 116*a* and 116*b* are selectively moved (e.g., deflected or undeflected) using, at least in part, raised portions 133*a* and 133*b*. In an embodiment, each of the raised portions 133*a* and 133*b* is to facilitate flexing the respective beams to disconnect an electrical contact between a conductive connector and a plurality of electrical contacts upon insertion of an object (e.g., an electrical module) into the cavity. When an object is received within (or removed from) with the cavity, a force is applied to (or relieved from) the raised portions 133*a* and 133*b*. Receiving an application of force on the raised portions 133*a* and 133*b*, at least in part, causes beams 116*a* and 116*b* to move to a deflected state (e.g., to deflect due to the force). When an electrical module is received within the hollow region bordered by guide walls 102*a*, 102*b*, 102*c*, and 102*d* (and therefore is received within the cavity), a portion (e.g., a housing) of the electrical module contacts and exerts a force (and/or imposes a defection) upon the raised portions thereby causing beams 116*a* and 116*b* to deflect outwardly away from the cavity, carrying with them clips 112 and forked ends 136 and 137. When the connector 120 is retained by clips 112*a* and 112*b*, the deflection of beams 116*a* and 116*b* outward away from the cavity causes a corresponding movement of the connector 120 relative to the interior cavity of guide device 100 to disconnect the electrical contact between a conductive connector and a plurality of electrical contacts. In an embodiment, each of the raised portions 133*a* and 133*b* is to facilitate unloading a force applied to the beam to establish an electrical contact between the conductive connector and the plurality of electrical contacts upon removal of the object from the cavity. Relieving the application of force (or removing a previously applied force by removing the object for the cavity) on raised portions 133*a* and 133*b*, at least in part, causes beams 116*a* and 116*b* to move to an undeflected state (e.g., to return to an undeflected shape due to a removal of the entire force) thereby establishing the electrical contact between the conductive connector and the plurality of electrical contacts. When no object is present in the cavity within walls 102 (and/or is not substantially filling the cavity), the interior surfaces of 116*a* and 116*b* remain coplanar with the interior surface wall 102*a* (e.g., beams 116*a* and 116*b* are undeflected, as described above).

It is noted that a single embodiment of system 100 can include at least one raised portion to (1) facilitate flexing the respective beams to disconnect an electrical contact between a conductive connector and a plurality of electrical contacts upon insertion of an object into the cavity, and/or (2) facilitate unloading a force applied to the beam to establish an electrical contact between the conductive connector and the plurality of electrical contacts upon removal of the object from the cavity. Each one of the at least one raised portion may perform only (1), only (2), or both (1) and (2).

FIG. 1B also shows further detail of clips 106*a* and 106*b*. Guide device 100 is attached to a circuit board using clips 106*a* and 106*b*. Clips 106*a* and 106*b* each respectively contain a retaining face 138*a* and 138*b*, an angled portion 140*a* and 140*b*, a flat portion 142*a* and 142*b*, and a vertical portion 144*a* and 144*b*. Upon angled faces 140*a* and 140*b* being inserted into corresponding openings in a circuit board, the angled faces 140*a* and 140*b* make a first contact with the circuit board. Advancing the heads into the opening beyond the first contact forces each of the vertical portions 144*a* and 144*b* to flex outward away from one another. After the retaining faces 138*a* and 138*b* completed pass through the openings the circuit board, the retaining faces 138*a* and 138*b* contact a bottom surface of the circuit board to retain the guide device in place with respect to the circuit board. The contact (between 138*a* and 138*b* and the bottom surface of the circuit board) secures the location (and orientation) of the guide device 100 with respect to the circuit board.

FIG. 1C illustrates conductive connector 120 coupled to guide device 100 using, at least in part, by clips 112*a* and 112*b*, corresponding pairs of forks 136*a* and 137*a* (e.g., first pair), and 136*b* and 137*b* (e.g., second pair). Conductive connector 120 is supported proximate the forked ends 136 and 137 (which are also free, cantilevered ends support be medial ends 114) of beams 116*a* and 116*b*. A vertical portion of each of clips 112*a* and 112*b* support the vertical portion 124*a* and 124*b*. A retaining face of clips 112*a* and 112*b* support a face of arm 126*a* and 126*b*. The arms 126*a* and 126*b* extend through respective gaps 110*a* and 110*b*, which lie between forked ends 136*a* and 137*a* and forked ends 136*b* and 137*b*, respectively. The arms 126*a* and 126*b* are supported by forked ends 136*a* and 137*a* and forked ends 136*b* and 137*b* and protrude into the cavity within the walls 102. The contact portions 128*a* and 128*b* lie within the cavity and are proximate arms 126*a* and 126*b*. In FIG. 1C, the beams 116*a* and 116*b* are undeflected since there is no object inserted into the cavity to exert a force (or displacement) on the beams.

Figure 2A:
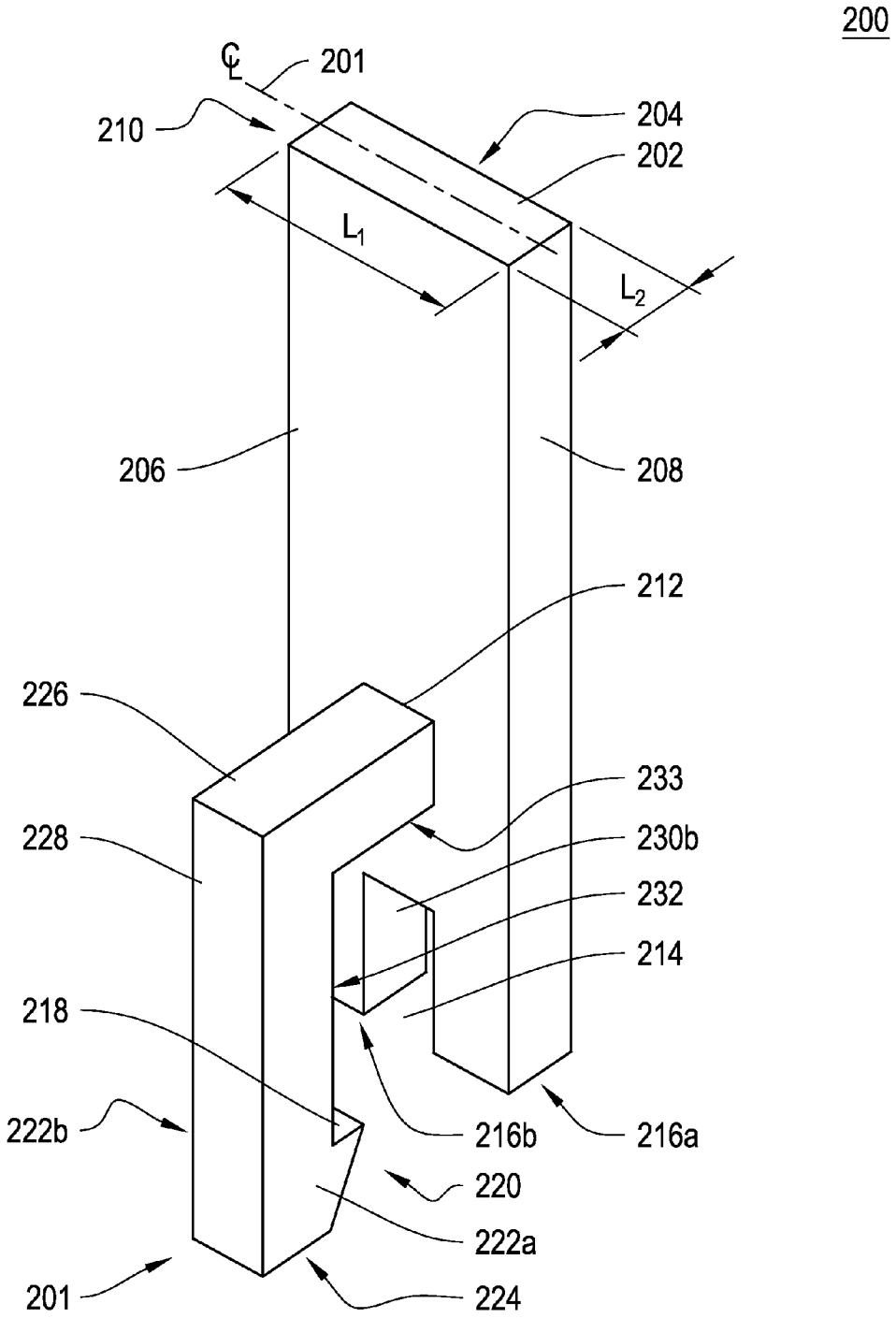
FIGS. 2A and 2B, illustrate a flexural element according to an embodiment of the present disclosure.
Figure 2B:
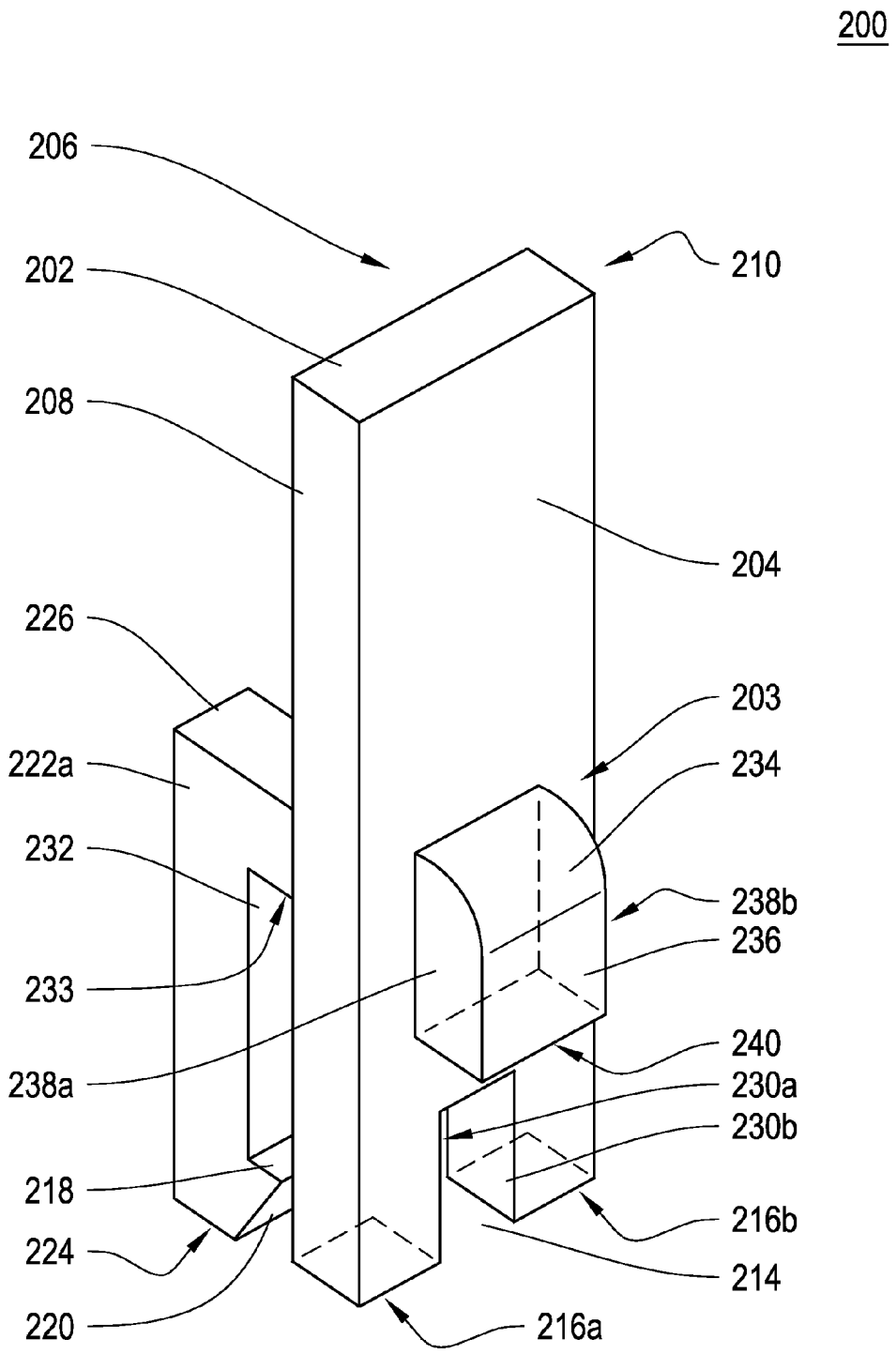

FIGS. 2A and 2B, illustrate a flexural element (i.e., flexural element 200) according to an embodiment of the present disclosure. Each of flexural elements 116*a* and 116*b* may be an embodiment of flexural element 200. FIG. 2A illustrates, among other things, face 206 and the components supported thereon. Flexural element 200 comprises first end 202 and second end 216 (i.e., end portions 216*a* and 216*b*), faces 206, 208, 204, and 210, and gap 214. First end 202 is located at an opposite extreme end relative to second end 216. Second ends 216*a* and 216*b* are forked around gap 214. The flexural element 200 is supported at end 202 by a support structure (e.g., guide wall 102*a* of guide device 100, a wall, a board, a guide device, at least one guide wall of a guide device, a printed circuit board (PCB), an area adjacent to an opening in a PCB, or a portion of any the forgoing, etc.). The support structure may, at least in part, border a cavity in which to receive an electrical module. End 216 is free and cantilevers out from the support structure. Thus, flexural element 200 is a beam that is cantilevered out from the support structure. Faces 206 and 204 are parallel to one another. Faces 208 and 210 are parallel to one another. Faces 206 and 208 are perpendicular to one another. Faces 204 and 210 are perpendicular to one another. Ends 216*a* and 216*b* are on opposite sides of gap 214 and are continuous with flexural element 200. Faces 230*a* and 230*b* are facial surfaces of ends 216*a* and 216*b*, respectively, and border gap 214.

Clip 201 is to retain a conductive connector (e.g., connector 120). The clip 201 is located proximate the second end 216 of flexural element 200. Clip 201 includes, among other things, a first end 212, a second end 224, and faces 226, 222*a*, 222*b*, 228, 220, 218, 232 and 233. Clip 201 is supported, at end 212, by face 206 and extends, for a portion, perpendicular to face 206. Second end 224 extends beyond end 216. Retaining surface 218 is located along the length of clip 201 between ends 212 and end 224. Each of faces 226, 222*a*, 233, 222*b*, 218, and 224 are perpendicular to face 206 of element 200. Each of faces 228 and 233 is parallel to face 206. Angled face 220 is neither parallel nor perpendicular to face 206. Face 218 is a retaining surface to contact a surface of the conductive connector and to hold the conductive connector in place with respect to flexural element 200 (e.g., while the flexural element undergoes bending and/or deflection). In some examples, the clip 201 and the flexural element 200 are a single continuous component (e.g., made of a molded material). Alternatively, the clip 201 may be a separate component that is attached to flexural element 200.

When clip 201 retains a connector, each of surfaces 232 and 218 contact a surface of the connector. For example, when clip 201 retains a connector, surface 232 contacts a vertical portion of the connector (e.g., vertical portions 124*a* and 124*b* of connector 120, FIGS. 1A, 1B, and 1C), while an opposite face of the vertical portion contacts surface 206. Retaining surface 218 supports the connector (e.g., contacting bottom face of arm 126*a* or 126*b* of connector 120) and prevents the connector from sliding along out of placement relative to the flexural element 200. The connector can be secured to the flexural element 200 by sliding the connector into the clip (e.g., inserting connector 120 such that a face of the arm 126*a* or 126*b* is slid in a direction from end 216 toward end 212). When the connector is being received by clip 201 (e.g., the connector is being inserted into the clip), the clip bends (or flexes) outward away from face 206. In some examples, the clip bends about end 212, and/or about the intersection of face 226 and face 228. After the connector is fully inserted into the clip, the clip returns to an undeflected shape, whereby retaining face 218 supports the connector as described above.

Flexural element 200 has one cross sectional dimension (e.g., length L1) that is larger than another cross sectional dimension (e.g., length L2). The flexural element deflects, due to loading of a raised portion, in the thinner dimension (i.e., bends about axis 201) to move ends 216*a* and 216*b* and thereby move a connector (e.g., conductive connector 120) located proximate the endpoint. Length L1 is measured across face 206 and is the perpendicular distance between faces 208 and 210. Length L2 is measured across face 208 and is the perpendicular distance between faces 206 and 204. In the embodiment of FIG. 2A, length L1 is greater than L2 (i.e., the dimension L1 is thicker than the dimension L2); L2 is less than L1 (i.e., the dimension L2 is thinner than the dimension L1). The thinner dimension (in this case dimension L2, bending about axis 201) has a bending stiffness that is less than a corresponding bending stiffness for the thicker dimension (in this case L1, bending about an axis perpendicular to axis 201). In other words, when an amount of force, X, is applied perpendicular to face 206 or face 204 (i.e., bending about axis 201), the flexural element 200 deflects by Y distance. If the same amount of force, X, is applied perpendicular to face 208 or face 210 (i.e., bending about a stronger axis), the flexural element 200 deflects by a distance that is less than Y. Flexural element 200 flexes about the weaker axis (as opposed to the stronger axis) to allow the end 216 to easily move (deflect) upon application of a force at a raised portion (e.g., raised portion 203 in FIG. 2B) of the flexural elements. The flexing (e.g., the deflection of the flexural element at the free ends 216) also moves a connector relative to one or more electrical contacts (e.g., input and output ports) to either connect or disconnect an electrical contact between the connector and the one or more electrical contacts (e.g., electrical ports on a circuit board). In an embodiment, a raised portion of the beam (e.g., raised portion 203 as is illustrated in FIG. 2B) facilitates the flexing to disconnect an electrical contact between a conductive connector (e.g., connector 120) and a plurality of electrical contacts upon insertion of the electrical module into a cavity (e.g., a cavity bordered by the aforementioned support structure for flexural element 200).

FIG. 2B illustrates an alternate view of flexural element 200. FIG. 2B illustrates, among other things, face 204 (which is an opposite face of flexural element 200 relative to face 206) and the components supported thereon. Face 204, which in some cases is an inner face, includes a raised portion 203. Raised portion 203 includes an angled face 234, vertical faces 238*a*, 238*b*, and 236, and horizontal portion 240. In this case, the angled face has a curvature that changes as it extends out from face 204. In other examples, the angled face 238 has a single angle (e.g., a flat angled face) that extends out from face 204. Each of vertical faces 238*a* and 238*b* is perpendicular to face 204. Vertical surface 236 is parallel to face 204 and is perpendicular to each of faces 238*a* and 238*b*. Face 240 is perpendicular to each of faces 204, 238*a*, 238*b*, and 236.

In an embodiment, the raised portion 203 extends into a cavity in which to receive an object. The object may be an electrical module that is, e.g., inserted into the cavity of guide device 100 of FIGS. 1A, 1B, and 1C. In operation, the raised portion 203 is to facilitate flexing the beam to disconnect an electrical contact between a conductive connector and a plurality of electrical contacts (e.g., ports on a PCB) upon insertion of the electrical module into the cavity. The angled face 234 is (for the raised portion) a first surface of contact with the object that is inserted into the cavity. First, the object contacts an upper portion of angled face 234. Next, as the object advances in a direction from end 202 toward ends 216*a* and 216*b*, the object moves along the angled surface 234 toward surface 236 and thereby displaces raised portion 203 out of the cavity. Finally, as the raised portion 203 is displaced out of the cavity, the displacement (and/or a force associated with the displacement) is transferred to the beam by the raised portion, thereby facilitating flexing the flexural element 200 (e.g., due to a moment about axis 201 generated by the displacement and/or the force). The flexing of the beam is elastic beam bending thereby allowing the beam to, after unloading, return to its undeflected shape with little or no residual (plastic) deformation.

An amount of deformation of the flexural element 200 (under a given force or deformation) may be modeled using mathematical equations for cantilevered beams from, e.g., Euler-Bernoulli beam theory or Timoshenko beam theory. The given force or deformation may be applied, in the model, at a centroid of the raised portion. Since the raised portion is displaced out of the cavity due to the object filling the cavity in place of the raised portion, the deformation of the beam may also be modeled by applying a displacement equal to a depth at which the raised portion extends into the cavity (e.g., a height of the raised portion 203 relative to surface 204).

It is noted that a single embodiment of system 200 can include at least one raised portion to (1) facilitate flexing the respective beams to disconnect an electrical contact between a conductive connector and a plurality of electrical contacts upon insertion of an object into the cavity, and/or (2) facilitate unloading a force applied to the beam to establish an electrical contact between the conductive connector and the plurality of electrical contacts upon removal of the object from the cavity. Each one of the at least one raised portion may perform only (1), only (2), or both (1) and (2).

Figure 3A:
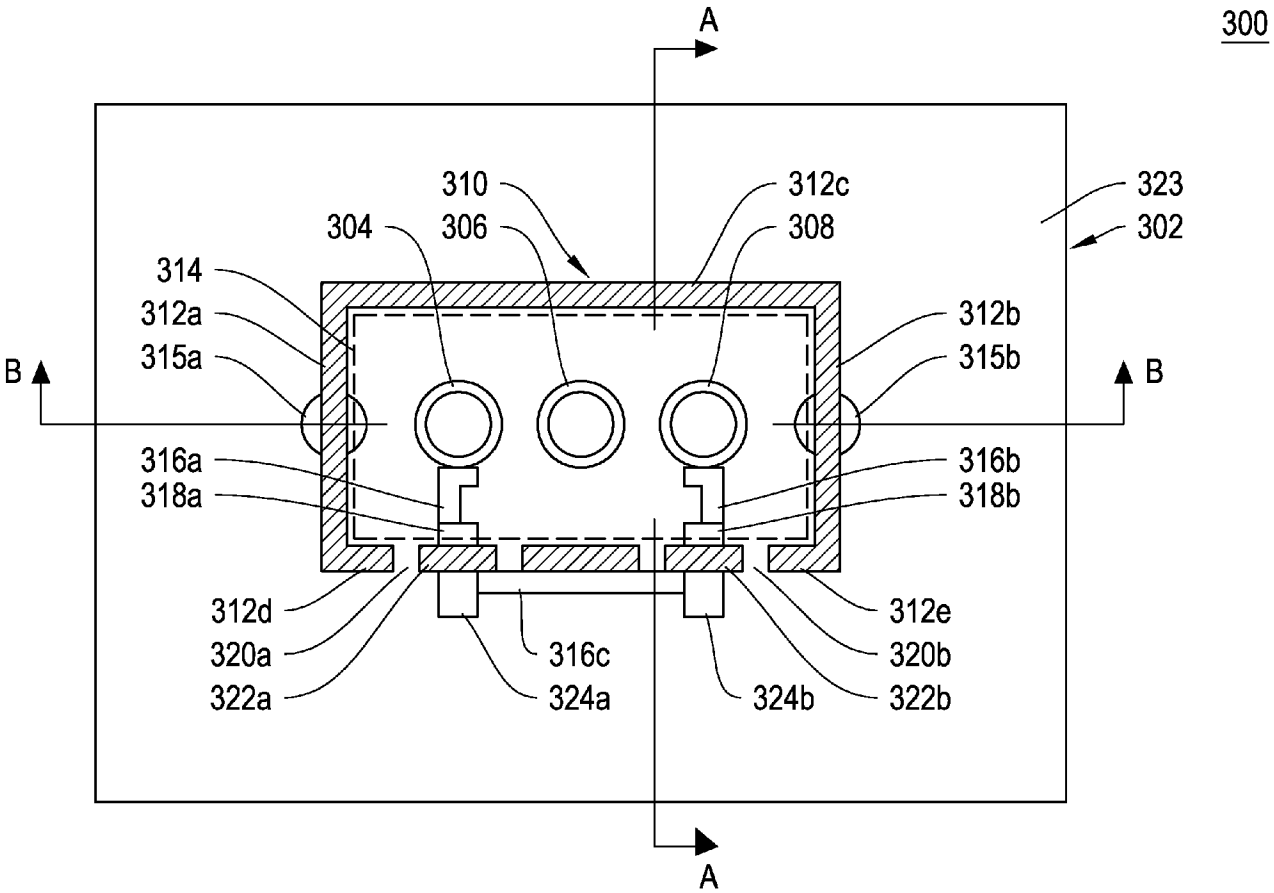
FIGS. 3A, 3B, and 3C are simplified diagrams of a system according to an embodiment of the present disclosure.
Figure 3B:
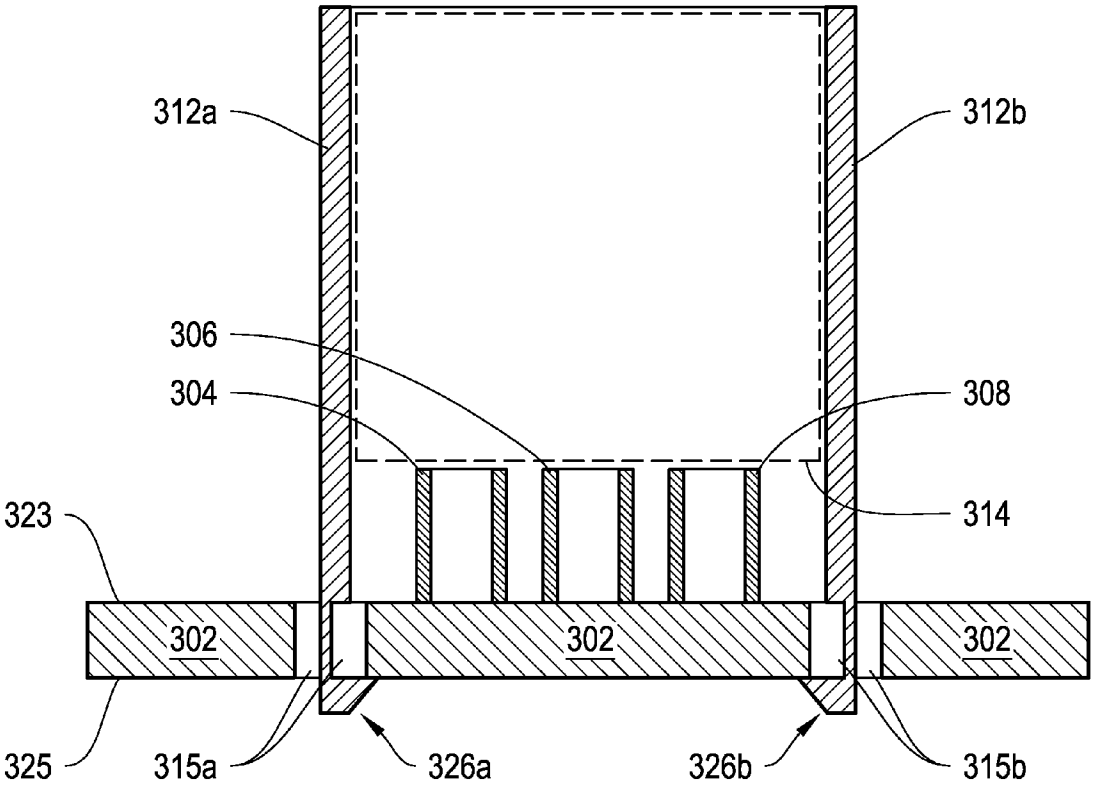
Figure 3C:
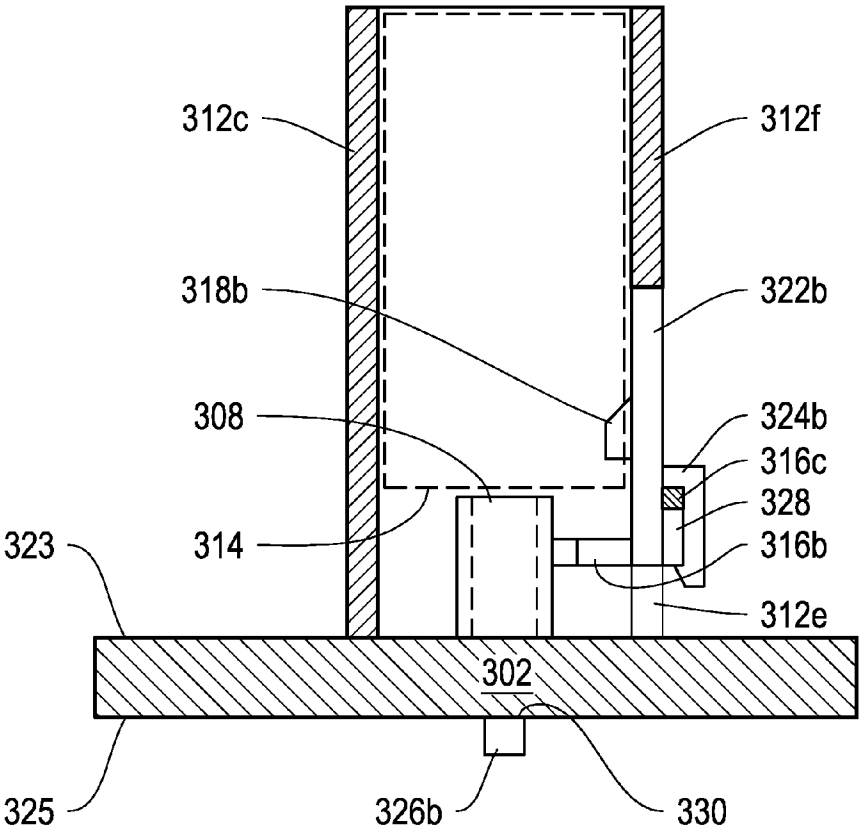

FIGS. 3A, 3B, and 3C are simplified diagrams of a system (system 300) according to an embodiment of the present disclosure. FIG. 3A is a plan view of system 300. FIG. 3B is a section view of system 300, as viewed along section lines B-B of FIG. 3A. FIG. 3C is a section view of system 300, as viewed along section lines A-A of FIG. 3A. In system 300, a guide device 310 is secured to a printed circuit board 302. In one example, guide device 310 is an embodiment of guide device 100. The printed circuit board 302 has a top surface 323 (illustrated in FIG. 3A) and a bottom surface 325 (illustrated in FIGS. 3B and 3C). Printed circuit board 302 also includes openings 315*a* and 315*b*, each of which extends from the top surface 323 to the bottom surface 325. Electrical ports 304, 306, and 308 are supported, at least in part, by the top surface 323 of printed circuit board 302. The ports may extend though the bottom surface of the board. The guide device 310 is secured to printed circuit board 302 by retention clips 326*a* and 326*b* (illustrated in FIGS. 3B and 3C), which extend through openings 315*a* and 315*b* respectively. A face of each of the retention clips 326*a* and 326*b* contacts and retains the bottom surface 325 of printed circuit board 302. The guide device 310 is coupled to an area of printed circuit board 302 that surrounds electrical ports 304, 306, and 308. Guide walls 312*a*, 312B, 312*c*, 312*d*, 312*e*, and 312*f* of guide device 310 border a cavity 314. Cavity 314 is a rectangular cubic volume in which to receive an object (e.g., an electrical module composing an electrical contact for input signals and an electrical contact for output signals, such as an attenuator, a pad attenuator utilized at a CATV headed, etc.).

Guide device 310 includes at least one flexural element attached to a guide wall of the guide device. The guide walls are, at least in part, a support structure for supporting flexural elements. In this example, guide wall 312*f* (as shown in FIG. 3C) supports cantilevered beams 322*a* and 322*b* (i.e., the flexural elements). Gaps 320*a* and 320*b* separate beams 322*a* and 322*b*, respectively, from guide walls 313*d* and 312*e*. Because the gaps 320*a* and 320*b* physically isolate the beams 322*a* and 322*b* from the guide walls, the beams can bend independent from the guide walls (i.e., the guide walls 312*d* and 312*e* do not bend as a result of the beams 322*a* and 322*b* bending). Each of the beams 322*a* and 322*b* include a first end, which is supported by the guide wall 312*f*, and a second end, which is cantilevered out from the guide wall 312*f*. The beams 322*a* and 322*b* include respective clips 324*a* and 324*b* and respective raised portions 318*a* and 318*b*. The clips 324*a* and 324*b* are supported on an outer face of beams 322*a* and 322*b*, respectively. Each of clips 324*a* and 324*b* is located proximate the respective second end of beams 322*a* and 322*b*. The clips 324*a* and 324*b* retain an electrically conductive connector 316. Although connector 316 is a single, continuous component, only portions of connector (i.e., portions 316*a*, 316*b*, and 316*c*) are visible in the FIGS. 3A, 3B, and 3C. Connector portion 316*a* is an arm and connector portion (e.g., corresponding to arm 126*a* and contact portion 128*a* of connector 120). Connector portion 316*b* is an arm and connector portion (e.g., corresponding to arm 126*b* and contact portion 128*b* of connector 120). 316*c* is a brace portion of connector 316 (e.g., corresponding to brace portion 122 of connector 120). Raised portions 318*a* and 318*b* are supported on an inner face of beams 322*a* and 322*b*, respectively. Each of raised portions 318*a* and 318*b* is located between the respective first end and the second end. Both raised portion 318*a* and raised portion 318*b* extended into the cavity 314.

Each of raised portions 318*a* and 318*b* is to facilitate flexing the respective beams 322*a* and 322*b* to disconnect an electrical contact between the electrically conductive connector 316 and the plurality of electrical contacts (e.g., ports 304, 306, and 308) upon insertion of the electrical module into the cavity. Turning to FIG. 3A, FIG. 3A illustrates, among other things, electrically conductive connector 316 in simultaneous physical contact (and electrical contact) with port 304 and port 308 thereby creating an electrical connection (e.g., a path of electrical connectivity) between ports 304 and 308. In some examples, port 304 is an input contact (an input port) and port 308 is an output contact (an output port). In this case, the electrically conductive connector 316 is in electrical contact simultaneously with the input contact and the output contact. Connector portion 316*b* is in contact with port 308;

connector portion 316*a* is in contact with port 304. Because no object is present in cavity 314, beams 322*a* and 322*b* are in an undeflected state and, as a result, the connector 316 is held in simultaneous contact with port 304 and port 308. Electrical signals may be transmitted between ports 304 and 308 via connector 316. For example, ports 304 and 308 transmit (e.g., using a processor coupled to the ports) electrical signals between one another via connector 316. When an object is inserted into cavity 316, the object displaces raised portions 318*a* and 318*b* out of the cavity, thereby facilitating flexing the beams 322*a* and 322*b* to disconnect the electrical contact between the electrically conductive connector 316 and the plurality of electrical contacts (e.g., ports 304, 306, and 308). In some examples, the raised portion facilitates the flexing of the beam to disconnect the electrical contact only after an electrical pin of the electrical module contacts one of the plurality of electrical ports 304, 306, and 308 during the insertion. As illustrated in FIG. 3B, cavity 314 is located above ports 304, 306, and 308 and is flanked on opposing sides by guide walls 312*a* and 312*a*.

FIG. 3C illustrates, among other things, beam 322*b* in an undeflected state (e.g., in an undeflected shape). In this undeflected state, clip 324*b* holds connector portion 316*b* in electrical contact with port 308. The raised portion 318*b* extends into cavity 314. Any object that is inserted into guide walls 312 (and that substantially fills cavity 314) will force raised portion 318*b* out of the cavity 314 thereby bending (flexing) beam 322*b* to disconnect contact between port 308 and connector portion 316*b*. Also, as illustrated in FIG. 3C, face 330 of the retention clip 326*b* contacts and retains the bottom surface 325 of printed circuit board 302; a corresponding face of the retention clip 326*a* contacts and retains the bottom surface 325 of printed circuit board 302.

FIGS. 4A, 4B, 5A, 5B, 6A, 6B, 7A, and 7B are diagrams of an embodiment of a system (system 400) according to the present disclosure. System 400 includes guide device 402, a printed circuit board portion 403, and an electrical module 419. Electrical ports 406, 408, and 410 are attached to the printed circuit board portion 403. The guide device 402 is secured to the printed circuit board portion 403, for example, as described with respect to the teachings of FIGS. 3A, 3B, 3C using clips 326*a* and 326*b*. The attachment between the guide device 402 and 403 is not shown only for the purpose of clarity of the figures. Electrical module 419 comprises a cap portion 424, a housing 426, and electrical contacts 418, 420, and 422. In an embodiment, housing 426 houses a plurality of hardware components, e.g., a processor, memory, attenuator components, etc. for transmitting and/or receiving signal via electrical contacts 418, 420, and 422. The electrical contacts 418, 420, and 422 are for contacting ports 406, 408, and 410, respectively. For example, when the electrical module 419 is fully inserted into a cavity of the guide device, the electrical contacts 418, 420, and 422 contact ports 406, 408, and 410, respectively. Guide device 402 contains the components as described with respect to guide devices 100 and 310. For example, guide device 402 includes, among other things, guide walls, element 417, and flexural elements 416*a* and 416*b*. A guide wall of guide device 402 supports flexural elements 416*a* and 416*b*. Flexural elements 416*a* and 416*b* include raised portions 414*a* and 414*b*, respectively. In addition, flexural elements 416*a* and 416*b* include clips 421*a* and 421*b*, respectively. Connector 412 is retained proximate a free end of each of flexural elements 416*a* and 416*b* using respective clips 421*a* and 421*b*.

FIGS. 4A, 4B, 5A, 5B, 6A, 6B, 7A, and 7B illustrate various phases of: connecting and/or disconnecting a first electrical connection between the electrical ports 406 and 410 on the printed circuit board portion 403 and the conductive connector 412 coupled to the guide device 402, and connecting and/or disconnecting a second electrical connection between the electrical ports 406 and 410 on the printed circuit board portion 403 and the electrical contacts 418 and 422 respectively on the electrical module 419. In an embodiment, the electrical module 419 may be any three-pin module suitable for connecting to the ports on the PCB 403 via guide device 402.

During the entire process of inserting the electrical module 419 into the guide device, ports 410 and 406 always have at least one electrical pathway for sending electrical signals between one another. When the module 419 is absent from the guide device (i.e., is not inserted into the guide device and/or cavity of the guide device), the first electrical connection exists between ports 410 and 406 through connector 412 (e.g., based on the beams 416 being undeflected). As the module is inserted, the second electrical connection is established between the ports 410 and 406 and the electrical contacts 418 and 422. At one or more points in time during the insertion, both the first and the second electrical connections are connected at the same time. Subsequent to the second electrical connection being established, the housing 429 of the module 419 forces the beams 416*a* and 416*b* to deflect, which disconnects the first electrical connection. In other words, the second electrical connection is established before the first electrical connection is disconnected (e.g., make-before-break). When the electrical module is in place (e.g., is fully inserted into the guide device), the electrical contacts on the guide provide an electrical pathway for signals to travel between ports 410 and 406. Likewise, when the electrical module is removed, the housing 426 disconnects physical contact with raised portions 414*a* and 414*b* (and thereby returning the beams to an undeflected state) to connect (or re-establish) the first electrical connection before the second electrical connection is disconnected. Thus, ports 410 and 406 always have an electrical pathway for sending electrical signals between one another and advantageously provide a seamless electrical connection between the ports (e.g., and maintain service to downstream customers that rely on a connection between ports 410 and 406).

Figure 4A:
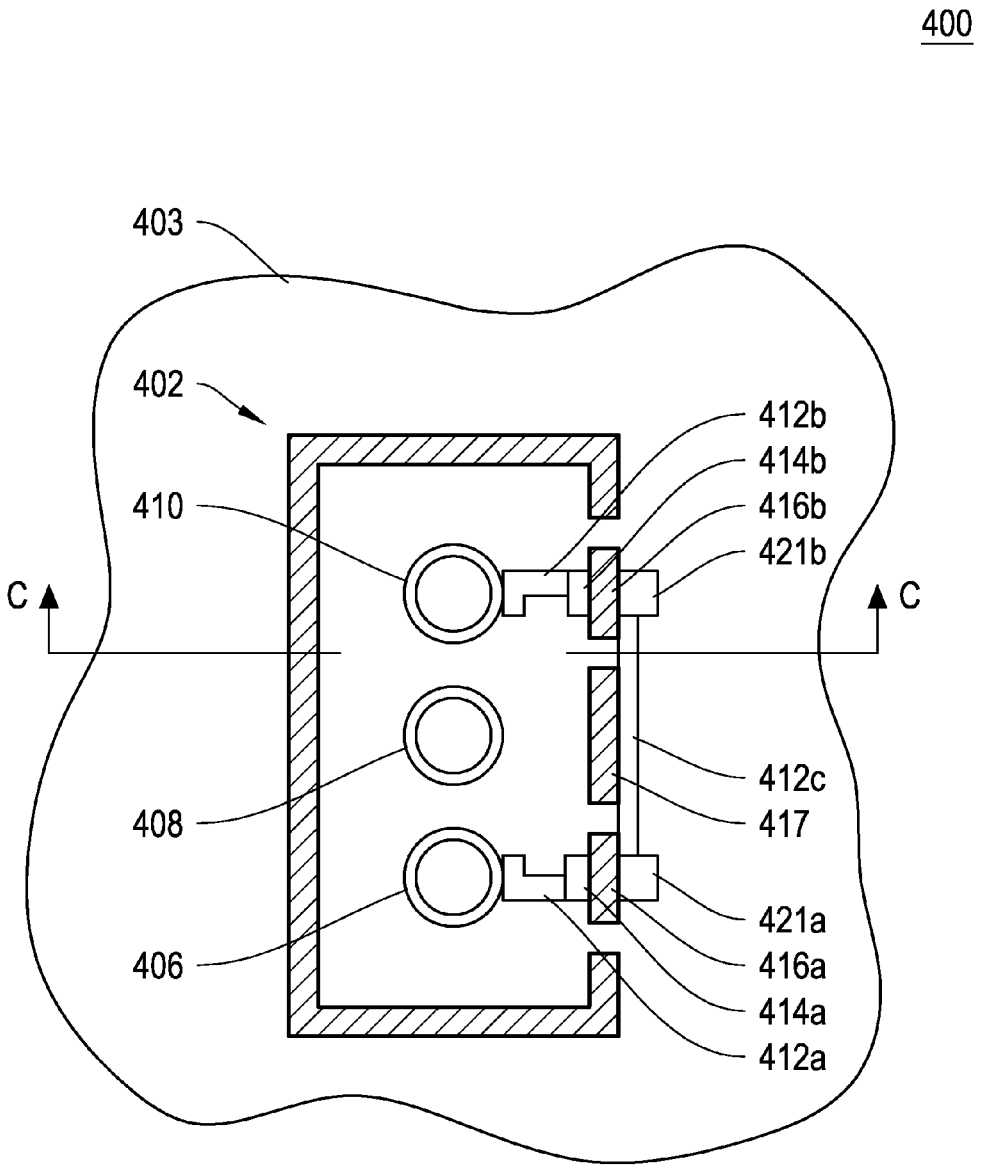
FIGS. 4A and 4B illustrate a system in a first configuration according to an embodiment of the present disclosure.
Figure 4B:
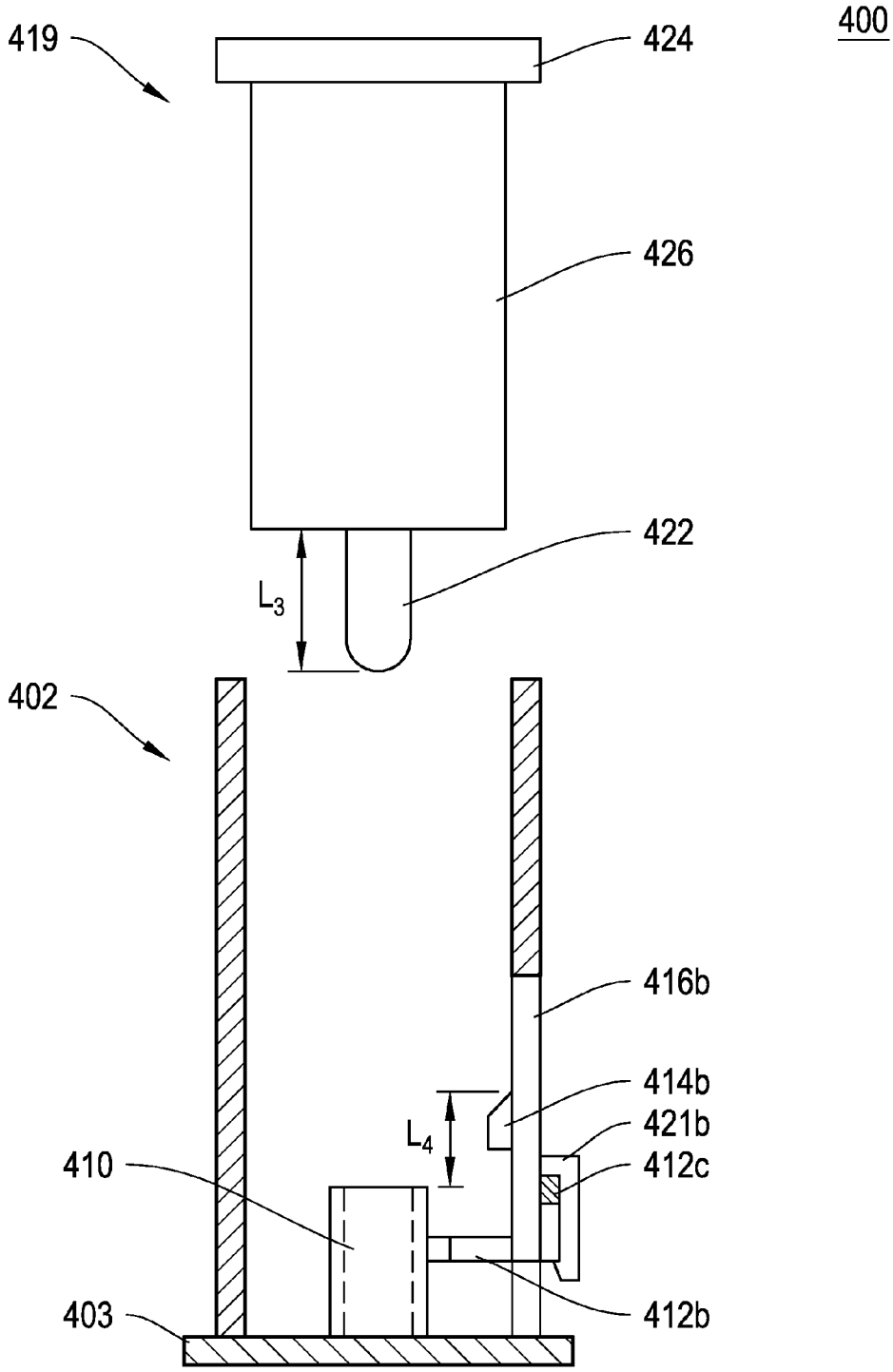
Figure 5A:
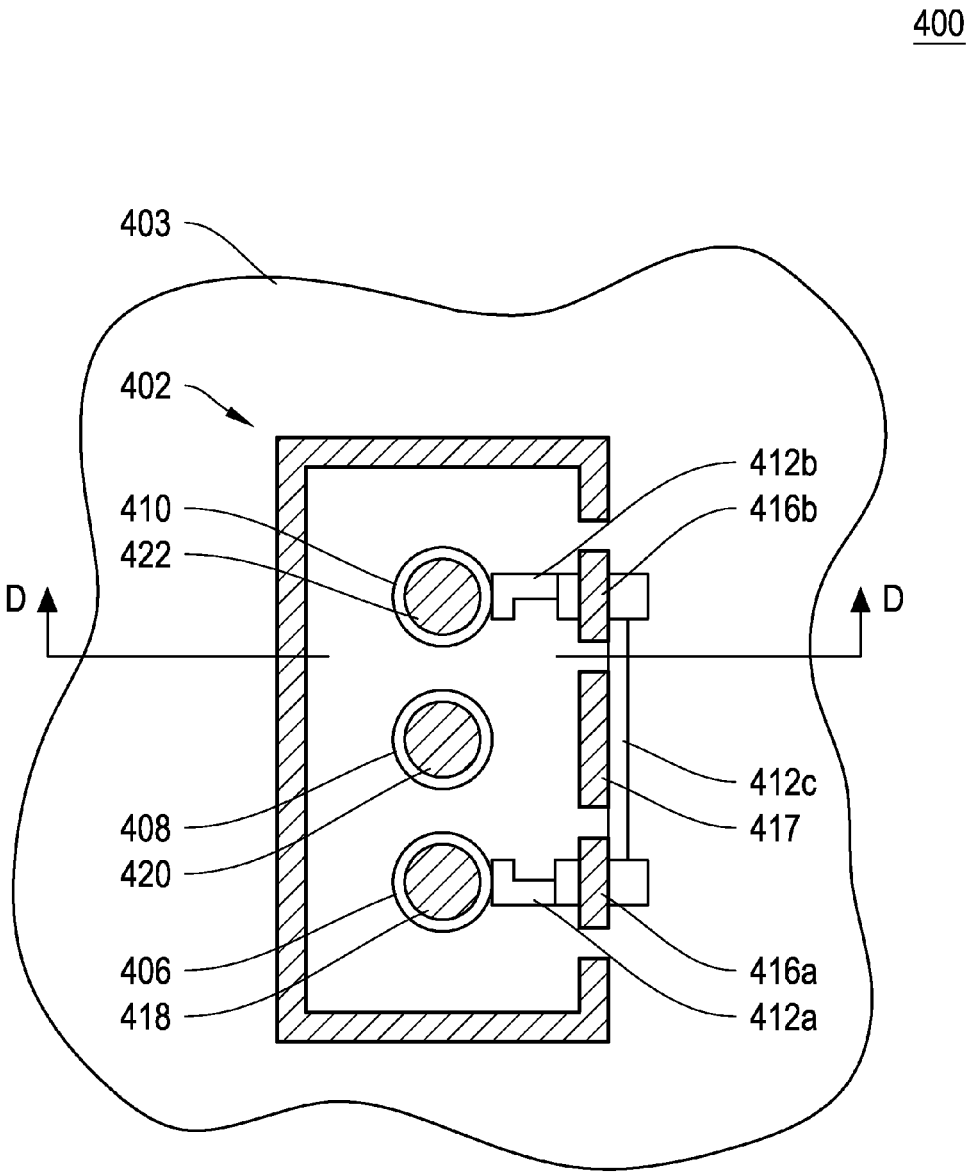
FIGS. 5A and 5B illustrate the system of FIGS. 4A and 4B in a second configuration according to an embodiment of the present disclosure.
Figure 5B:
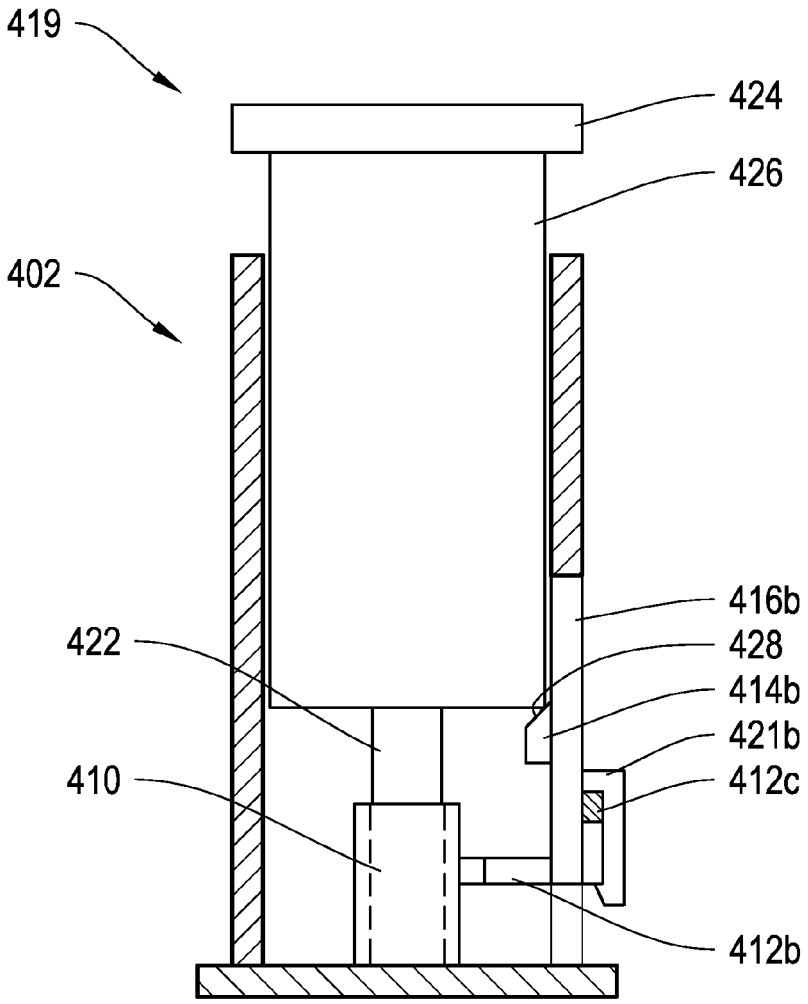

FIGS. 4A and 4B illustrate a first configuration, wherein the second electrical connection is not established and only the first electrical connection is established. FIGS. 5A and 5B illustrate a second configuration, wherein both the second electrical connection and the first electrical connection are established. FIGS. 6A, 6B, 7A, and 7B illustrate a third configuration, wherein only the second electrical connection is established and the first electrical connection is not established. The second configuration is a transitional configuration to provide a seamless electrical signal to the ports regardless of whether the configuration changes from the first configuration to the third configuration via the second configuration (e.g., insertion of the electrical module) or changes from the third configuration to the first configuration via the second configuration (e.g., removal of the electrical module). FIGS. 4A, 4B, 5A, 5B, 6A, 6B, 7A, and 7B (and the various configurations) are described in further detail below.

Turning to FIGS. 4A and 4B, FIGS. 4A and 4B illustrate system 400 in the first configuration according to an embodiment of the present disclosure. FIG. 4A is a plan view of system 400 looking down into a cavity within the walls of the guide device and looking down upon the tops of ports 406, 408, and 410. FIG. 4B is a section view of system 400, as viewed along section lines C-C of FIG. 4A. When system 400 is in the first configuration, the electrical module 419 is not inserted into (or has been removed from) the guide device 402 and thus the second electrical connection between the electrical ports 406 and 410 on the printed circuit board portion 403 and the electrical contacts 418 and 422 on the electrical module 419 is not established. Because electrical module 419 is not within the guide device 402 (e.g., is absent from the cavity of guide device 402, has been removed from the cavity of guide device 402, etc.) and thus exerts no force (and/or deflection) on the raised portions 414*a* and 414*b*, the flexural elements 416*a* and 461*b* are in an undeflected state. When the beams 416*a* and 416*b* are in the undeflected state: each beam is straight, each beam is parallel to the other, and each of a front and a back face of the beam is coplanar with a front and a back face of the supporting guide wall of guide device 402. Beams 416*a* and 416*b* retain connector 412 using clips 421*a* and 421*b* (e.g., as described with respect to clips 112*a* and 112*b* in FIGS. 1A, 1B, and 1C). Thus, when beams 416*a* and 416*b* are in the undeflected state, clip 412 is held in contact with at least one of the plurality of contacts 406, 408, and 410. In this case, clip 412 is in physical contact with port 406 at connector portion 412*a* and is in contact with port 410 at portion 412*b*.

Conductive connector 412 being in physical contact with ports 410 and 406 and enables the first electrical connection between the electrical ports 406 and 410 (on the printed circuit board portion 403) and the conductive connector 412 (coupled to the guide device 402). In an embodiment, conductive connector 412 is made of an electrically conductive material such as metal. Ports 406 and 410 may transmit electrical signals between one another via the first electrical connection over connector 412. For example, port 406 may transmit (e.g., using a processor associated with the PCB portion 403 and/or a processor associated with module 419) a signal via connector 412 on a pathway through connector portion 412*a*, then through connector portion 412*c*, and next through connector portion 412*b*, finally reaching port 410. Likewise, port 410 may transmit (e.g., using a processor associated with the PCB 403 and/or a processor associated with module 419) a signal via the v 412 a pathway through connector portion 412*b*, then through connector portion 412*c*, and next through connector portion 412*a*, and finally reaching port 406. When the signal is received at port 406 and/or port 408, the signal may be further transmitted to a processor or electrical module (if plugged in). In general, when no force and/or no deflection is applied to the beam (e.g., by housing 426 contacting raised portions 414*a* and 414*b*) the first electrical connection is maintained between connective conductor 412 and ports 410 and 406.

In an embodiment, the raised portions 414*a* and 414*b* facilitate flexing of the beams 416*a* and 416*b* to disconnect an electrical contact (e.g., disconnects the first electrical connection) only after an electrical pin of the electrical module 419 contacts one of the plurality of electrical ports (e.g., establishes the second electrical connection) during insertion of the electrical module 419 into the guide device 402. The electrical contacts 418, 420, and 422 extend from a face of the housing 426 by a length L3. A top face of ports 406, 408, and 410 is separated from a top point of raised portions 414*a* and 414*b* by a length L4. Length L3 is greater than length L4. Because length L3 is greater than length L4, the electrical contacts 418, 420, and 422 make contact with ports 406, 408, and 410 (i.e., establishing the second electrical connection) before the housing 426 contacts the raised portions 414*a* and 414*b* to facilitate flexing the beam to disconnect the electrical contact between the electrical ports 406, 408, and 410 and the conductive connector 412 (i.e., before disconnecting the first electrical connection). Because the second electrical connection is established before disconnecting the first electrical connection, an electrical pathway between ports 406 and 410 always exists (e.g., there is a seamless electrical signal to the ports 406, 408, and 410).

Turning to FIGS. 5A and 5B, FIGS. 5A and 5B illustrate system 400 in a second configuration according to an embodiment of the present disclosure. FIG. 5A is a plan view of system 400. FIG. 5B is a section view of system 400, as viewed along section lines D-D of FIG. 5A. Section lines C-C and D-D are in similar locations with respect to system 400. When system 400 is in the second configuration, the electrical module 419 is partially inserted into (or partially removed from) guide device 402. The electrical module 419 is inserted into guide device 402 at a depth such that electrical contacts 418, 420, and 422 make contact with ports 406, 408, and 410, respectively (i.e., establishing the second electrical connection). The second electrical connection is established before housing 426 makes an initial contact with raised portion 414*b* at angled face 428 (and a corresponding face of raised portion 416*a*).

As shown in FIGS. 5A and 5B, ports 406 and 410 are simultaneously contacted by clip 412 and by the electrical contacts 418 and 422. Thus, the second electrical connection and the first electrical connection are simultaneously connected and are both available as pathways for an electrical signal between ports 406 and 410. For example, the electrical module 419 may provide a pathway for a signal between ports 406 and 410 using electrical contacts 422 and 418 respectively, such that signals from port 410 travel through electrical contact 422 traversing internal hardware in electrical module 419 and next through electrical contract 418 and finally to port 406. Likewise, a similar pathway (in reverse) may exist such that signals from port 406 travel through electrical contact 418 traversing internal hardware in electrical module 419 and next through electrical contract 422 and finally to port 410.

In an example of inserting the module 419 into guide device 402, FIGS. 5A and 5B correspond to a first contact that is made between the housing 426 and the raised portion 414*b* at face 428 (and a corresponding face of raised portion 414*a*). At the first contact, the beams 416*a* and 416*b* are undeflected. The beams 416*a* and 416*b* deflect as the module 419 is inserted further into guide device 402 beyond the first point. In an example of removing the module 419 from guide device 402, FIGS. 5A and 5B corresponds to a final contact that is made between the housing 426 and the raised portion 414*b* at face 428 (and a corresponding face of raised portion 414*a*). During removal, the beams 416*a* and 416*b* remain deflected until the module 419 reaches the point of final contact, at which point the beams 416*a* and 416*b* are undeflected.

Figure 6A:
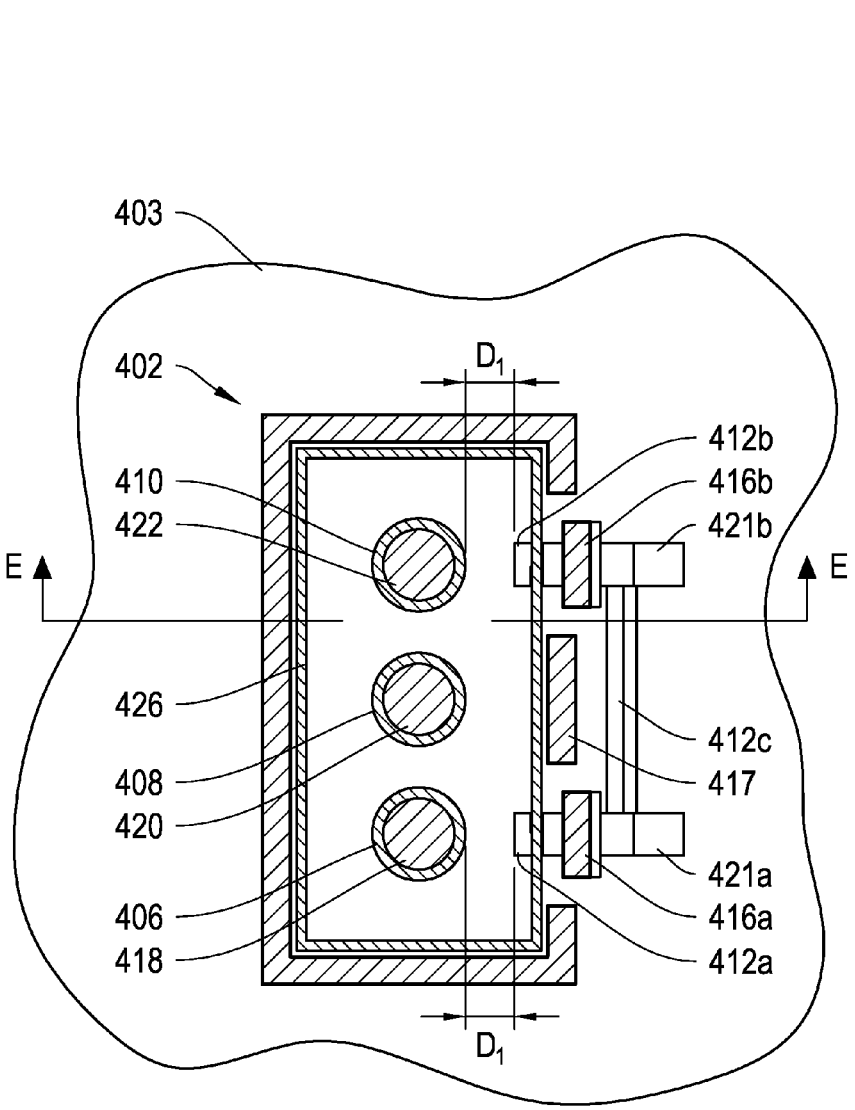
FIGS. 6A and 6B illustrate the system of FIGS. 4A and 4B in a third configuration according to an embodiment of the present disclosure.
Figure 6B:
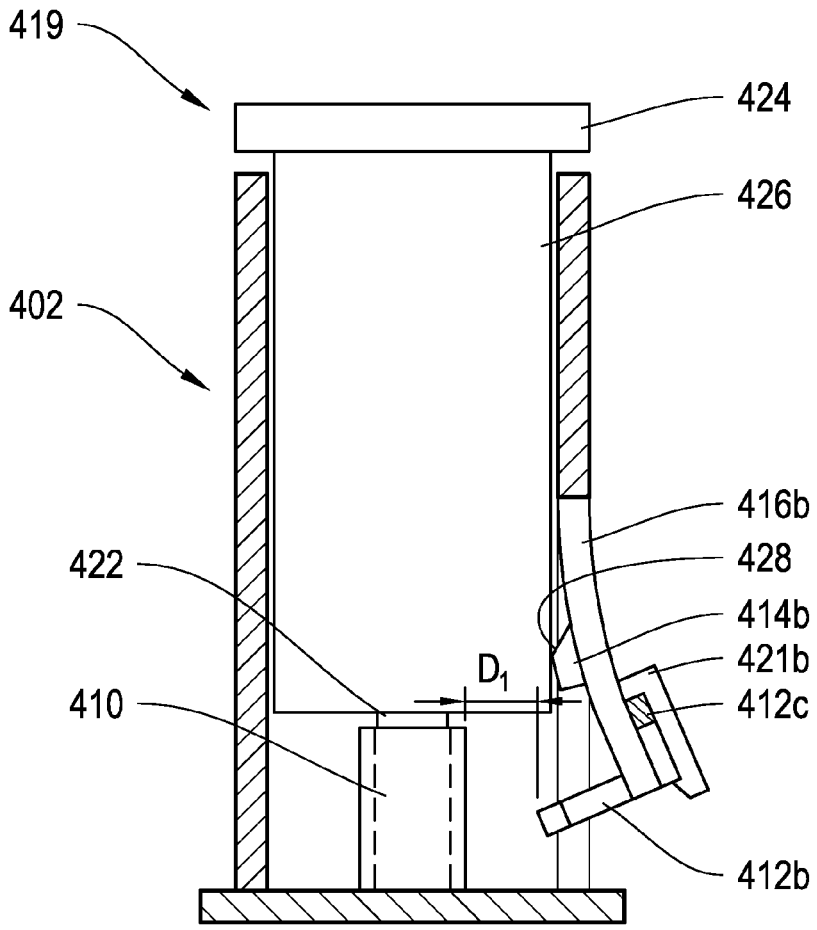

Turning to FIGS. 6A and 6B, FIGS. 6A and 6B illustrate system 400 in a third configuration according to an embodiment of the present disclosure. FIG. 6A is a plan view of system 400. FIG. 6B is a section view of system 400, as viewed along section lines E-E of FIG. 6A. Section lines C-C, D-D, and E-E are in similar locations with respect to system 400. When system 400 is in the third configuration, the electrical module 419 is inserted into the guide device 402 beyond the first contact. The housing 426 applies a force and/or deflection to the raised portions 414*a* and 414*b* and has thereby moved the raised portion in a direction that is outward away from a cavity within the guide walls of the guide device 402. Because the raised portions 414*a* and 414*b* were advanced out of the cavity by the insertion of housing 426, the raised portions 414*a* and 414*b* transferred the force and/or deflection to the beams 416*a* and 416*b* thereby deflecting the beams at their free ends and disconnecting the electric contact between connector 412 and ports 406 and 410. In the deflected state, beams 416*a* and 416*b*, hold connector 412 in a position where it is not in electrical contact with ports 410 and 406 and, further, is separated from ports 410 and 406 by a distance D1. In an embodiment, the distance D1 is equal to 0.6 mm.

In an example of inserting the module 419 into guide device 402, FIGS. 6A and 6B correspond to a point when the module 419 is inserted into guide device 412 beyond a point of initial contact with raised portions 414*a* and 414*b* (e.g., the first contact). In an example of removing the module 419 from guide device 402, FIGS. 6A and 6B correspond to a point when module 419 is only slightly removed from guide device 402 and has not yet cleared a point of final contact with the raised portion 414*b* (e.g., the final contact).

Figure 7A:
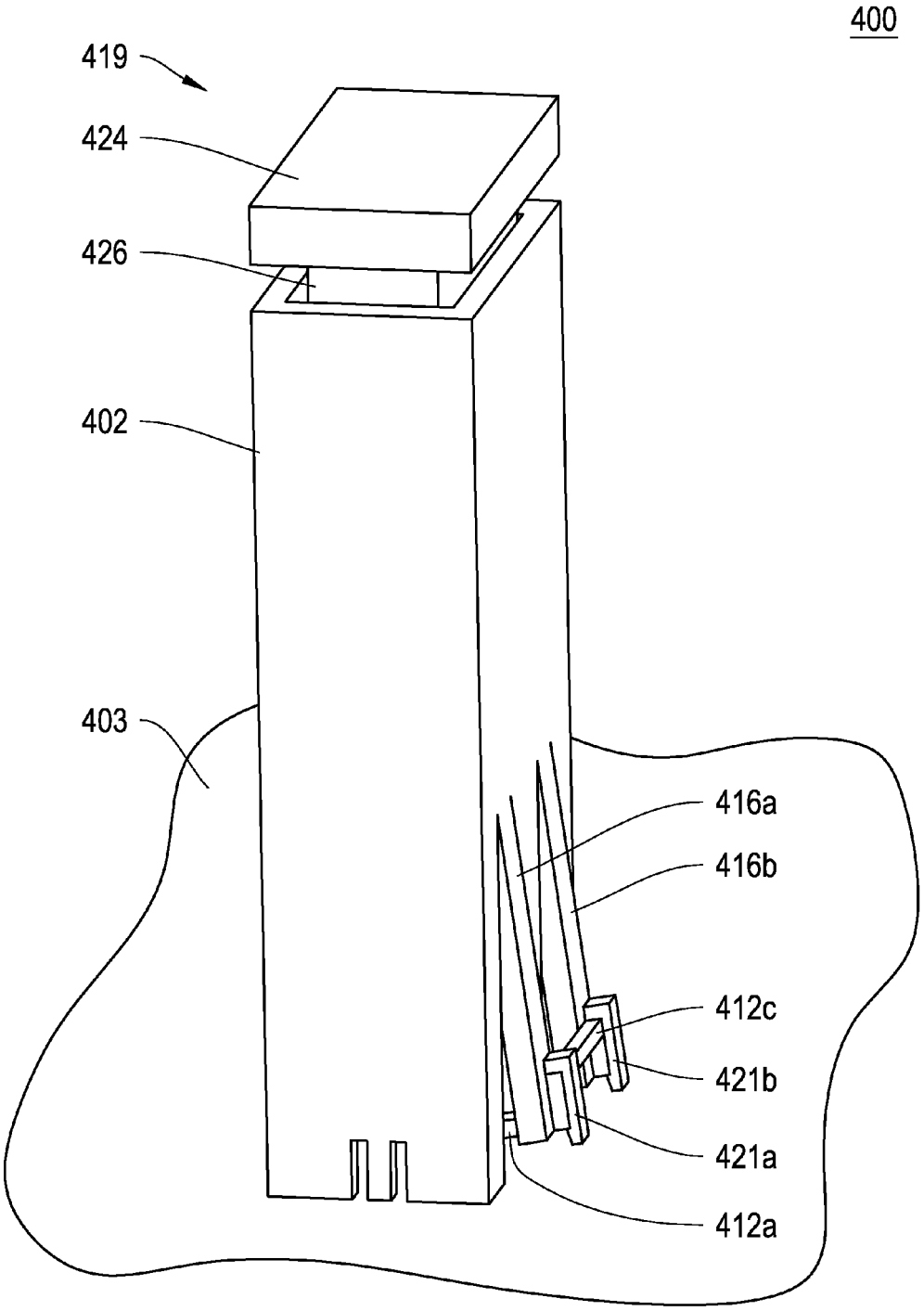
FIGS. 7A and 7B illustrate three-dimensional isometric views of the system of FIGS. 6A and 6B according to an embodiment of the present disclosure.
Figure 7B:
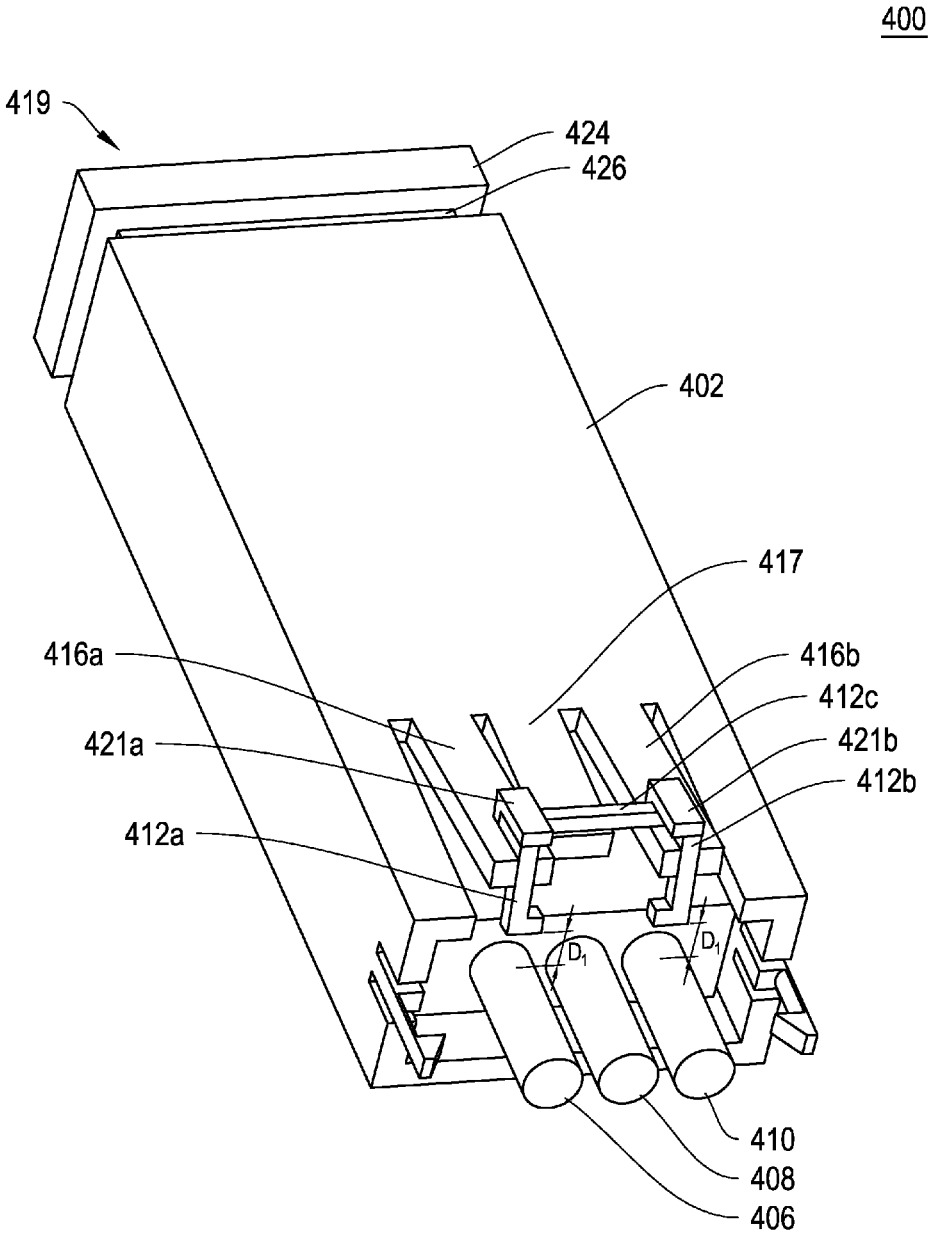

Turning to FIGS. 7A and 7B, FIGS. 7A and 7B illustrate three-dimensional isometric views of the system of FIGS. 4A and 4B in the third configuration according to an embodiment of the present disclosure (as depicted in FIGS. 6A and 6B). 7A is an isometric view from the top of the PBC portion 403. FIG. 7B shows a view from the bottom of the PCB portion 403. In FIG. 7B, the PBC portion 403 has been hidden only for clarity of the figures although the ports associated with PCB (i.e., ports 406, 408, and 410) are illustrated. The beams 416*a* and 416*b* are deflected and flexed outwardly away from the cavity due, at least in part, to the contact between housing 426 and raised portions 414*a* and 414*b* (not visible in this view). In the deflected state, the beams 416*a* and 461*b* have deflected, (at least at an endpoint) by a distance of D1, thereby removing/disconnecting contact between connection component 412 and ports 406 and 410. Because the beam has deflected (e.g., at the free end) by a distance D1, the connector 412 is also moved a distance D1 away from the ports 406 and 410. In some examples, D1 is 0.6 mm.

As described above: (1) FIGS. 4A and 4B illustrate a first configuration, wherein the second electrical connection is not established and only the first electrical connection is established; (2) FIGS. 5A and 5B illustrate a second configuration, wherein both the second electrical connection and the first electrical connection are established; and (3) FIGS. 6A, 6B, 7A, and 7B illustrate a third configuration, wherein only the second electrical connection is established and the first electrical connection is not established. In an embodiment, a method of inserting an electrical module (e.g., any three-pin module suitable for connecting to ports on a PCB, a pad attenuator, etc.) comprises providing a system in the first configuration; receiving, by a guide device in the system, application of a force from the electrical module to advance the system from the first configuration to the second configuration; and receiving, by the guide device in the system, application of another force from the electrical module to advance the system from the second configuration to the third configuration. In another embodiment, a method of removing an electrical module comprises providing a system in the third configuration; receiving, by a guide device in the system, relief of a force from the electrical module to, at least in part, withdraw the electrical module from the guide device, wherein the relief of the force advances the system from third configuration to the second configuration; and receiving, by a guide device in the system, relief of an another force from the electrical module to, at least in part, withdraw the electrical module from the guide device, wherein the relief of the another force advances the system from the second configuration to the first configuration.

Each of FIGS. 8A, 8B, 9A, 9B, and 10 illustrate three-dimensional isometric views of an embodiment of a system (system 800) according to the present disclosure. System 800 includes a guide device 804, a portion of a printed circuit board 806, an electrical module 802, and a flexural element 826. Guide device 804 is coupled to the printed circuit board portion 806 according to the teachings of clips 326*a* and 326*b* as illustrated in FIGS. 3A, 3B, and 3C. Printed circuit board portion 806 comprises three electrical ports 816, 818, at 820 and an opening 824. Each of electrical ports 816, 818, at 820 pass through printed circuit board portion 806 such that one portion of each of the ports extends above a top surface of board 806 and another portion of each the of the ports extends below a bottom surface of board 806. As discussed with respect to FIG. 3, the walls of guide device 804 border a cavity in which to receive electrical module 802. The opening 824 is adjacent the cavity. Electrical module 802 comprises a raised portion 808, which is a semi spherical dome that extends outwardly from a face of the electrical module 802. Electrical module 802 also includes three electrical contacts 810, 812, and 814 each of which extends downward from a bottom face of the module 802. The electrical contacts 810, 812, and 814 are for contacting ports 816, 818, at 820, respectively. Flexural element 826 comprises first end 842, a vertical portion 828, a curved portion 830, a raised portion 832, an angled portion 834, a brace portion 836, and a second end 838. The first end is supported by a support structure, which in this case is an area on the bottom surface of the printed circuit board 806 adjacent to the opening 824 (and bordering the cavity). Vertical portion 828 extends substantially vertically from the first and 842 and is passed from the bottom surface to the top surface of the printed circuit board 806. The curved portion 830 extends in a direction from the vertical portion 828 toward and into the cavity of guide device 804. The raised portion 832 is proximate and end of curved portion 830 and is aligned vertically aligned with (and parallel with) vertical portion 828. Angle faced 834 extend from an end of the raised portion 832 and extends in a downward angled direction away from the cavity. Brace portion 836 is located between Angle faced 834 and second end 838, and extends in a downward, angled direction toward the cavity. Brace portion 836 passes through the opening 824 in the printed circuit board 806. The PCB 806 only directly supported end 842; second and 838 is cantilevered and is not directly supported by the supports structure. Second end 838 retains conductive connector 840 using clipped end (e.g., a hollowed region of end 838 in which 840 is retained, or an area molded around connector 840). Other components of system 800 are similar to components of system 300 and/or system 400. A difference between system 800 and systems 300 or 400 is that the flexural component 826 is supported at a first and 842 by the printed circuit board, which serves as a support structure.

Raised portion 832 extends into the cavity bordered by guide 804. When the electrical module 802 is inserted into guide 804, raised portion 808 contacts raise portion 832 causing flexural element 826 to deflect outwardly away from the cavity and (similar to the teachings of FIGS. 4A, 4B, 5A, 5B, 6A and 6B) thereby facilitates selectively connecting and/or disconnecting an electrical contact between connector 840 and ports 816 and 820.

Flexural element 826 can be made of any flexible material (e.g., plastic, metal, etc.). In some examples, plastic is used instead of metal (e.g., instead of a conductive material) to avoid the potential to introduce any stray inductance or capacitance in the system (which may influence electrical signals transmitted between ports 816 and 820).

FIGS. 8A, 8B, 9A, 9B, and 10 illustrate various phases of: connecting and/or disconnecting a first electrical connection between the electrical ports 816 and 820 on the printed circuit board portion 806 and the conductive connector 840 coupled to the flexural element 826 (which is supported by printed circuit board portion 806), and connecting and/or disconnecting a second electrical connection between the electrical ports 816 and 820 on the printed circuit board portion 806 and the electrical contacts 810 and 814 respectively on the electrical module 802.

During the entire process of inserting the module 802 into the guide device 804, ports 816 and 820 always have at least one electrical pathway for sending electrical signals between one another. When the module 802 is absent from the guide device (i.e., is not inserted into the guide device and/or cavity of the guide device, as in FIGS. 8A and 8B), the first electrical connection exists between ports 816 and 820 through connector 840 (e.g., based on the flexural element 826 being undeflected). As the module is inserted, the second electrical connection is established between the ports 816 and 820 and the electrical contacts 418 and 422 (in addition to the first electrical connection). At one or more points in time during the insertion (or removal), both the first electrical connection and the second electrical connection are connected at the same time. Subsequent to the second electrical connection being established, the raised portion 808 on the housing of the module 802 forces the flexural element 826 (e.g., by applying a deflection and/or force to raised area 832 of flexural element 826) to deflect, which disconnects the first electrical connection. In other words, the second electrical connection is established before the first electrical connection is disconnected (e.g., make-before-break). When the electrical module 802 is in place (e.g., is fully inserted into the guide device), the electrical contacts on the guide provide an electrical pathway for signals to travel between ports 816 and 820. Likewise, when the electrical module is removed, the raised portion 808 disconnects physical contact with raised portions 832 (and thereby returns the flexural element 826 to an undeflected state) to connect (or re-establish) the first electrical connection before the second electrical connection is disconnected. Thus, ports 816 and 820 always have an electrical pathway for sending electrical signals between one another and advantageously provide a seamless electrical connection between the ports (e.g., and maintain service to downstream customers that rely on a connection between ports 816 and 820).

Figure 8A:
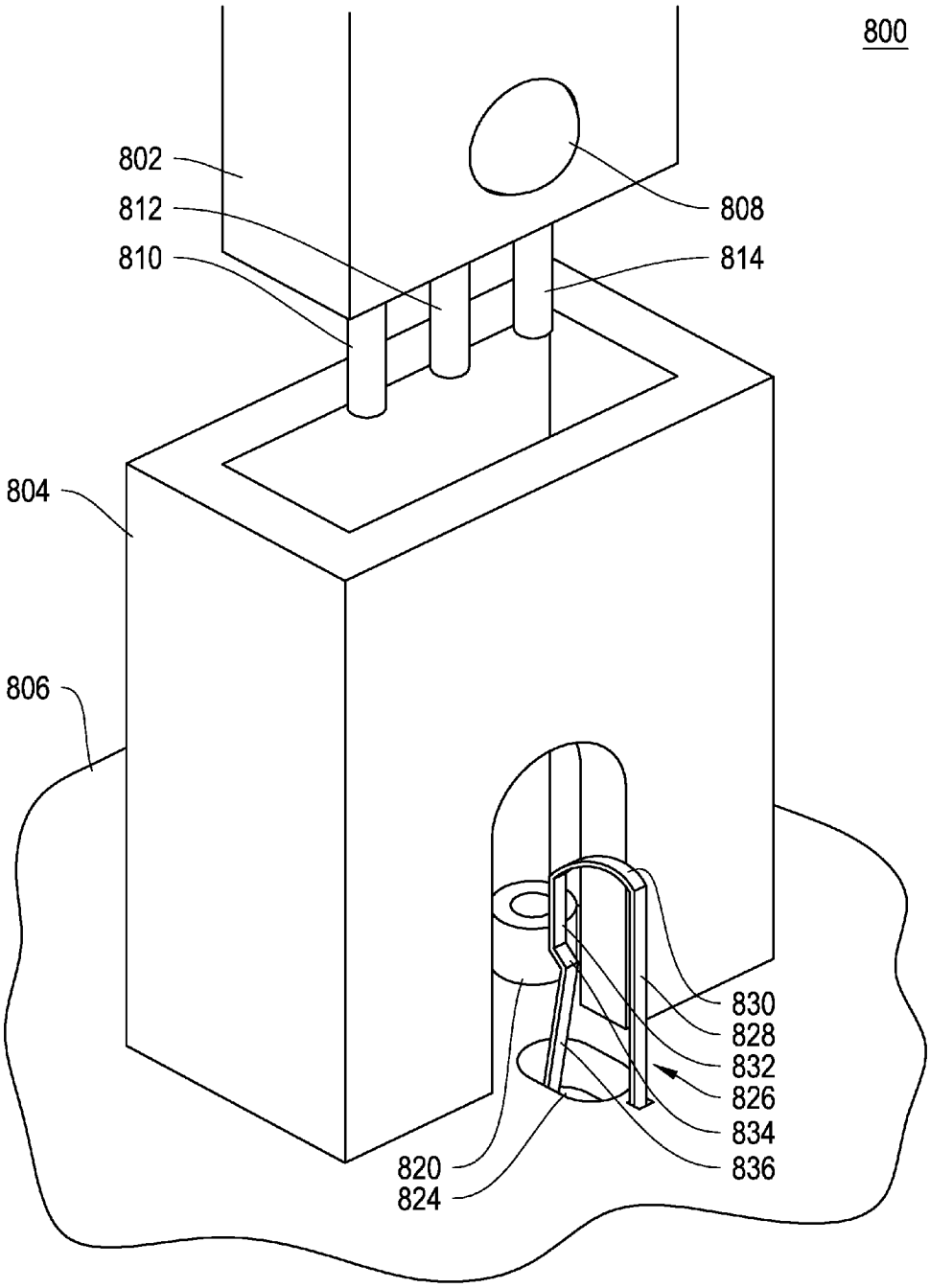
FIGS. 8A and 8B illustrate another system in a first configuration according to an embodiment of the present disclosure.
Figure 8B:
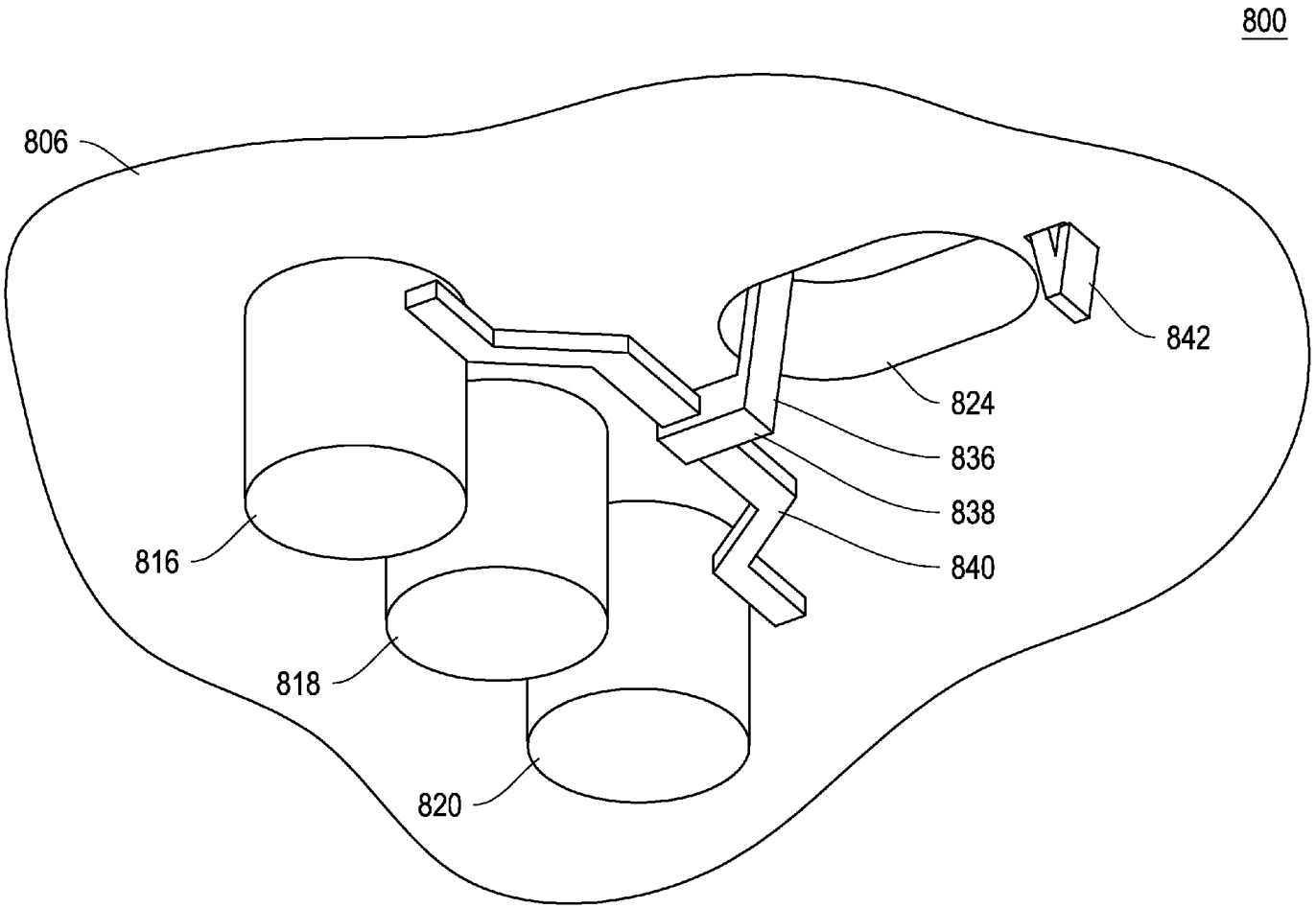

Turning now to FIGS. 8A and 8B, FIG. 8A shows a view from the top of PCB portion 806; FIG. 8B shows a view from the bottom of PCB portion 806. Because module 802 is not inserted into guide device 804, flexural element 826 is undeflected. In other words, no force and/or no deflection is applied to flexural element 826 by the raised portion 808. In the undeflected state, flexural element 826 holds connector 840 in simultaneous contact with electrical port 816 and electrical port 820.

Figure 9A:
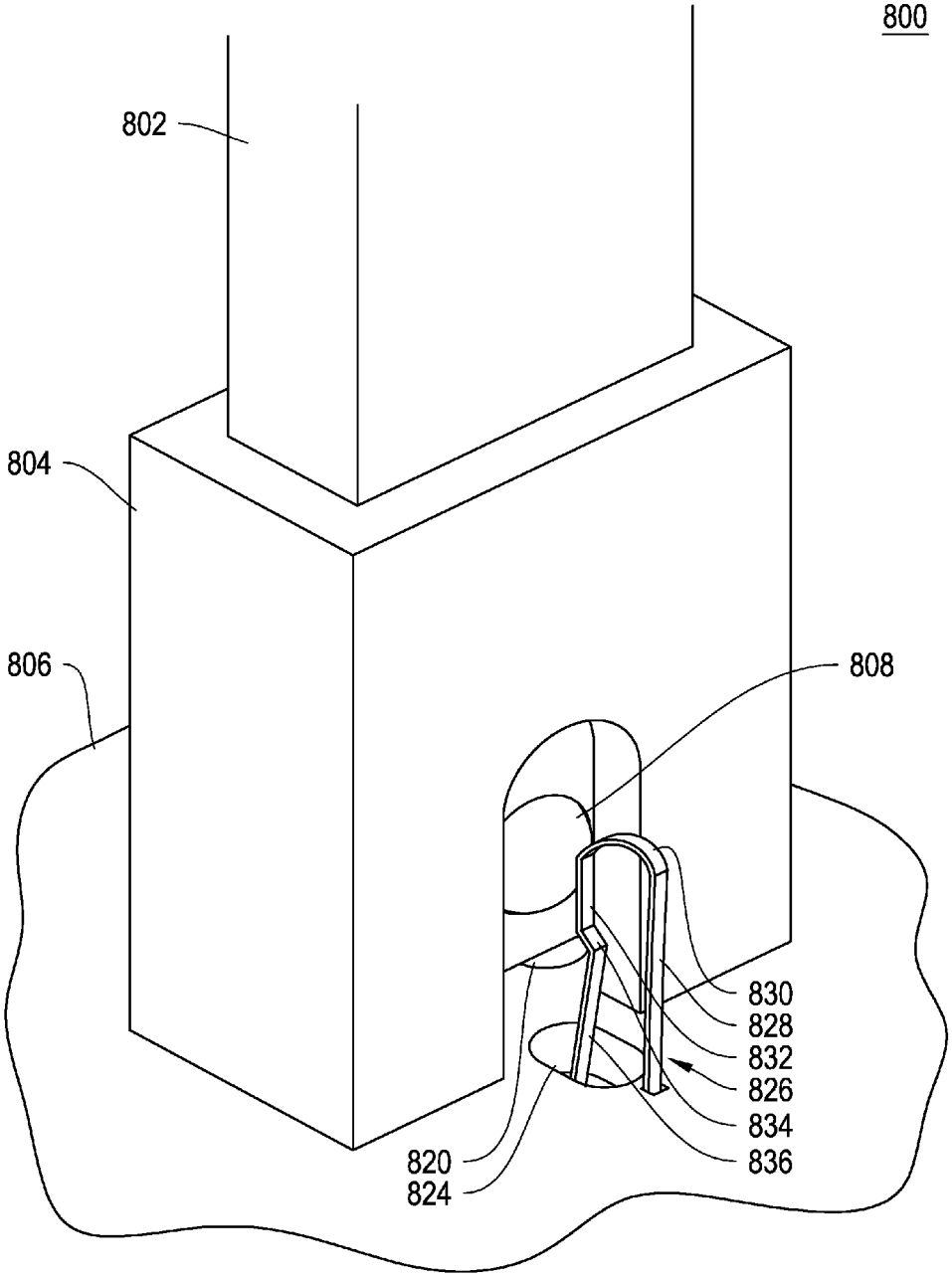
FIGS. 9A and 9B illustrate the system of FIGS. 8A and 8B in a second configuration according to an embodiment of the present disclosure.
Figure 9B:
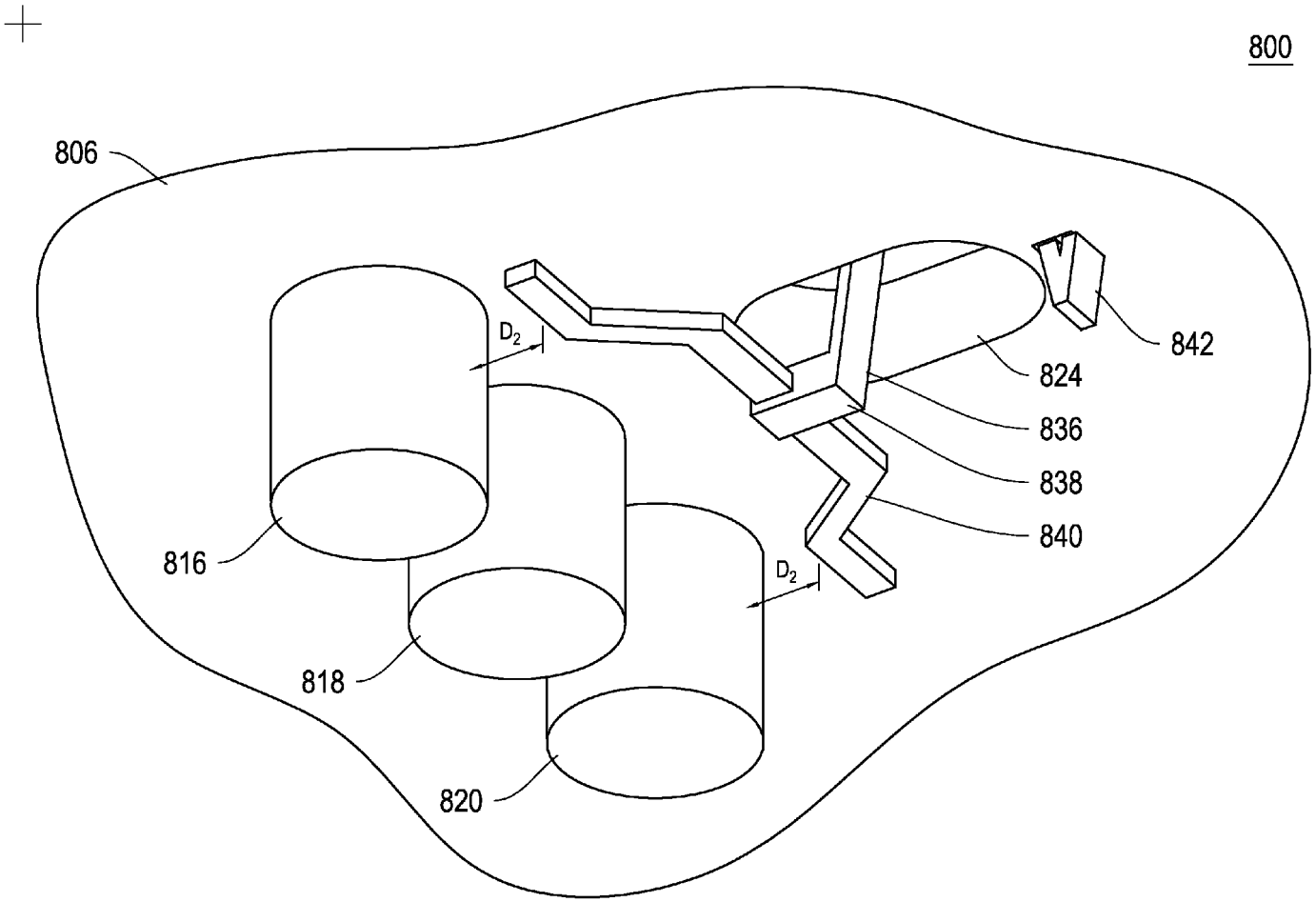

In a transition between FIGS. 8A and 8B and FIGS. 9A and 9B, may occur in a number of ways. In an example of inserting the module 802 into guide device 804, the system may begin at start point as shown in FIGS. 8A and 8B. As the module 802 is inserted into the guide device, a first contact is made between the raised area 808 and the raised portion 832. At the first contact, the flexural element 826 is undeflected. The flexural element 826 deflects as the module 802 is inserted further into guide device 804 beyond the first point, as shown in FIGS. 9A and 9B. In an example of removing the module 802 from guide device 804, the system may begin at start point as shown in FIGS. 9A and 9B. As the module 802 is removed from the guide device, a final contact is made between the raised area 808 and the raised portion 832. During removal, the flexural element 826 remains deflected until the module 802 reaches the point of final contact, at which point the flexural element 826 is undeflected. In this case, the FIGS. 8A and 8B illustrate the system after the module 802 has been fully removed from the guide device.

Turning now to FIGS. 9A and 9B, FIGS. 9A and 9B illustrate the system 800 at a point where module 802 has been advanced beyond the first contact between raised portion 808 and raised portion 832. Because raised portion 808 on module 802 applies a deflection and/or force to flexural element 826 the second end 838 deflects and carries with it connector 840, thereby disconnecting connector 840 from electrical contact with ports 816 and 820. When flexural element 826 is fully deflected under the deflection and/or force imposed by raised portion 808, the connector 840 is separated from ports 816 and 820 by a distance D2. In an embodiment, the distance D2 is about 0.6 m. In another embodiment, the distance D2 is greater than or equal to 0.6 mm.

Figure 10:
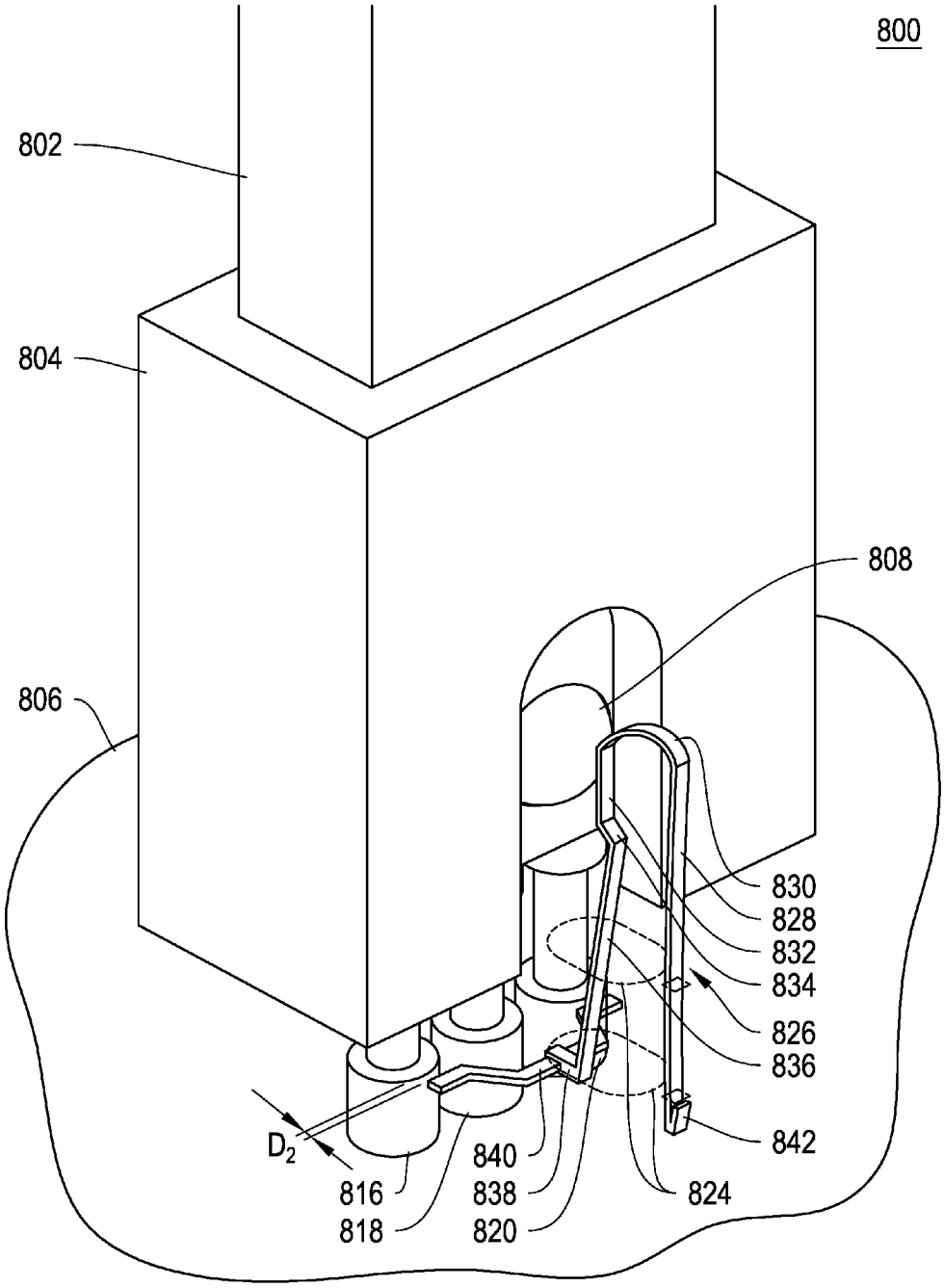
FIG. 10 illustrates three-dimensional isometric views of the system of FIGS. 9A and 9B according to an embodiment of the present disclosure.

FIG. 10 shows a view of system 800 in the same state that was shown in FIGS. 9A and 9B. A difference between FIG. 9 and FIG. 10 is that, in FIG. 10, printed circuit board 806 has been hidden from view for clarity of the figures (however holes 824 are shown with a dashed line to show the relationship between the opening and the flexural component 826). Again, in the state shown in FIG. 10, the raised portion 808 (on module 802) is in contact with the raised portion 832 (on flexural element 826) such that the flexural element 826 is deflected thereby displacing the connector 840 from the ports 816, 818, 820 by a distance D2.

In each of the examples discussed herein, seamless electrical signal between components is provided during insertion and/or removal of an electrical module to/from an apparatus (e.g., a guide device) based on selectively flexing at least one flexural element. At any point during the insertion and/or removal, electrical contact is always maintained between ports on a printed circuit board (e.g., by a conductive connector and/or by electrical contacts on the electrical module). For example, the ports may transmit signals over at least one of the following: (1) an electrical connection between a connector (e.g., any of connectors 840, 120, 316, 412) and the ports, or (2) an electrical connection between contacts on an electrical module (e.g., any of electrical contacts 810, 812, and 814 on module 802; or electrical contacts 418, 420, and 422 on module 419) and the ports. In some cases, only connection (1) is present (i.e., active and capable of transmitting electrical signals) and connection (2) is not present. In other cases, both connection (1) and connect (2) are present. In other cases, only connection (2) is present and connection (1) is not present.

Some conventional conductive connectors introduce stray conductance or spurious capacitance at a level that is disruptive to signal transmission. Tests of various embodiments according to the present disclosure, show, in part, that conductive connectors (e.g., any of connectors 840, 120, 316, 412) can be made of metal without introducing negative stray capacitance or spurious inductance.

FIGS. 11, 12, 13, 14, and 15 illustrate exemplary test data for various embodiments of the present disclosure. The data in FIGS. 11, 12, 13, 14, and 15 shows that a metal conductive connector, according to an embodiment of the present disclosure, does not negatively impact the performance of the systems described herein when a frequencies ranging from 5 MHz to 1250 MHz are used in an application. FIG. 11 is a table (table 1100) of data for systems according to the present disclosure using pad attenuators having various levels of attenuation. Columns 1102, 1104, 1106, 1108 corresponds to data for insertion loss. Column 1110 corresponds to data for input return loss. Column 1112 corresponds to data for output return loss. Each of columns 1102, 1104, 1106, and 1108 measure insertion loss at a single, constant frequency. For example, the data in column 1102 is data for each of the various pad attenuator values with a starting frequency and stopping frequency that are both equal to 100 MHz. Likewise, column 1104 provides to data where the test was performed with a starting frequency of 500 MHz and a stop frequency of 500 MHz (and was held constant at 500 Mhz between the start and stop). In contrast, the data for columns 1110 and 1112 are provided over a frequency spectrum that ranges from 5 MHz to 1250 MHz. For example, the frequency begins at 5 MHz and advances up to and including 1250 MHz. The data in each of rows 1114, 1116, 1118, 1120, 1122, 1124, 1126, 1128, 1130, 1132, 1134, and 1136 correspond to single data points measured at the respective frequencies for insertion loss based on the intersecting column (i.e., columns 1102, 1104, 1106, 1108). For example, the data at the intersection of row 1114 and column 1102 corresponds to a system having no pad attenuator plugged into a guide device where no connector is present. This value provides a baseline performance. The data at the intersection of row 1116 and column 1102 corresponds to a system having no pad but with the connector separated from a port by a distance of 0.6 mm. The difference between the two aforementioned data cells illustrates an influence of the connector being absent versus the connector being present and 0.6 mm away from the port. The data at the intersection of rows 1114 and 1116, and column 1102 was measured at a start and stop frequency of 100 MHz, where the frequency is held constant between the start and stop and thus is measured at a constant frequency. The data at the intersection of same rows (i.e., rows 1114 and 1116) and column 1104 is measured at a constant frequency of 500 MHz. In contrast, the data at the intersection of rows 1114 and 1116, and column 1110 is measured at a start frequency of 5 MHz and an end frequency of 1250 MHz (e.g., increasing the frequency at a constant rate from 5 to 1250 MHz over the duration of the test). The single data result in column 1110 is a maximum value that resulted from the testing the setup in a frequency range from 5 MHz to 1250 MHz. For example, the intersection of row 1114 and column 1110 shows that when the pad attenuator is in place and no connector is in place, the maximum input return loss is 0 decibels (dB) (i.e., measured as the frequency varies from 5 MHz to 1250 MHz).

Figure 12:
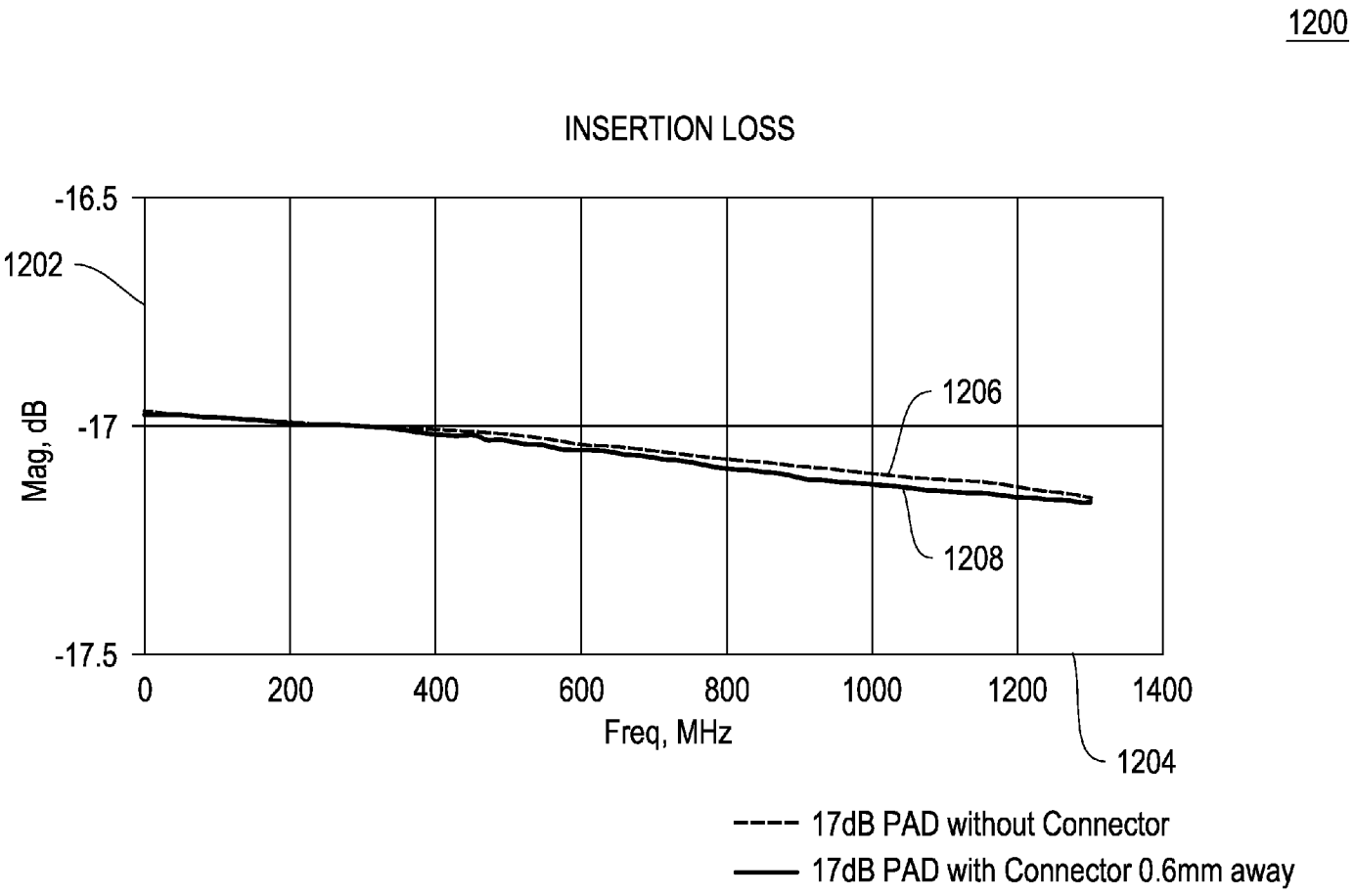
Figure 13:
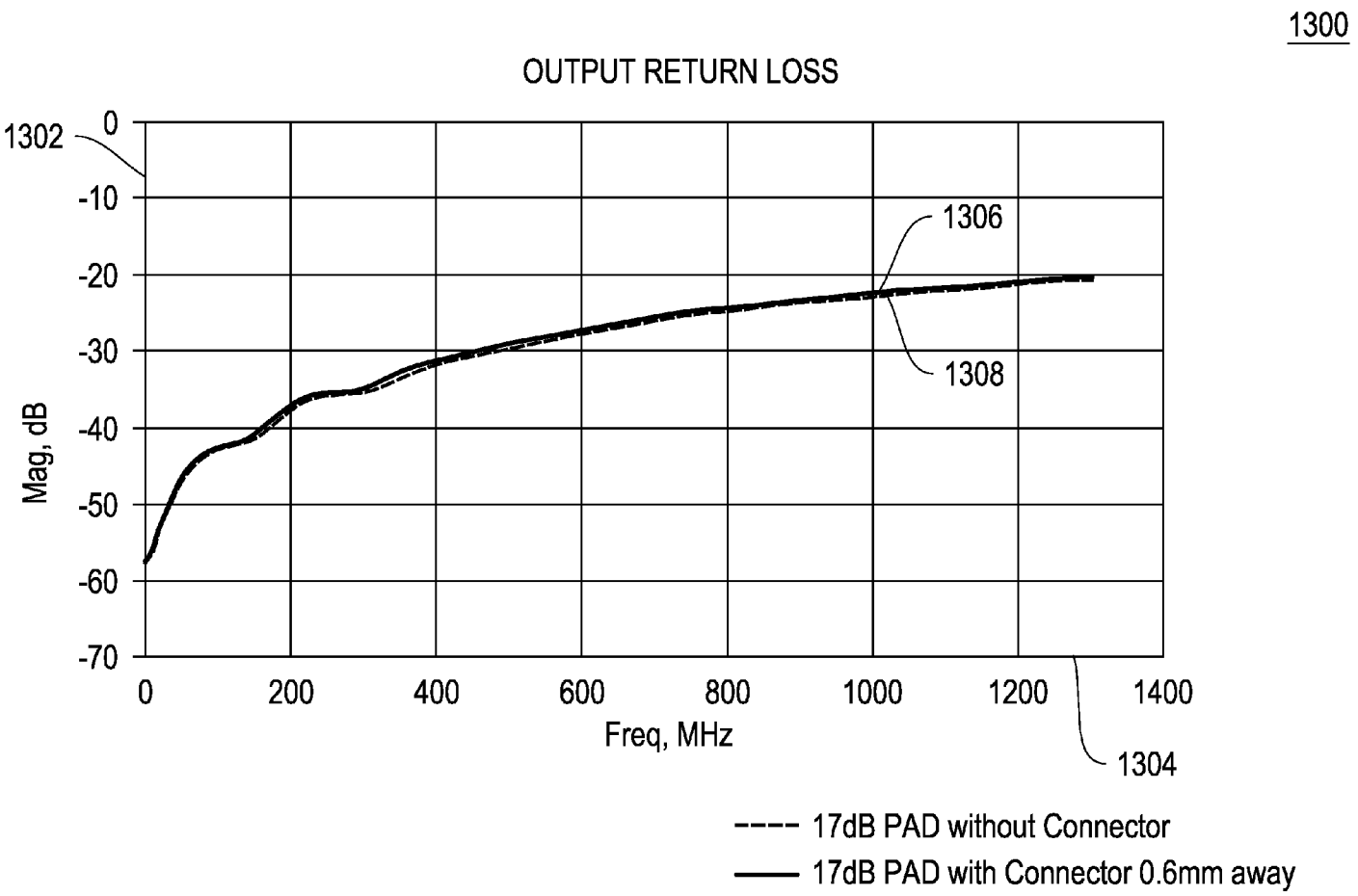
Figure 14:
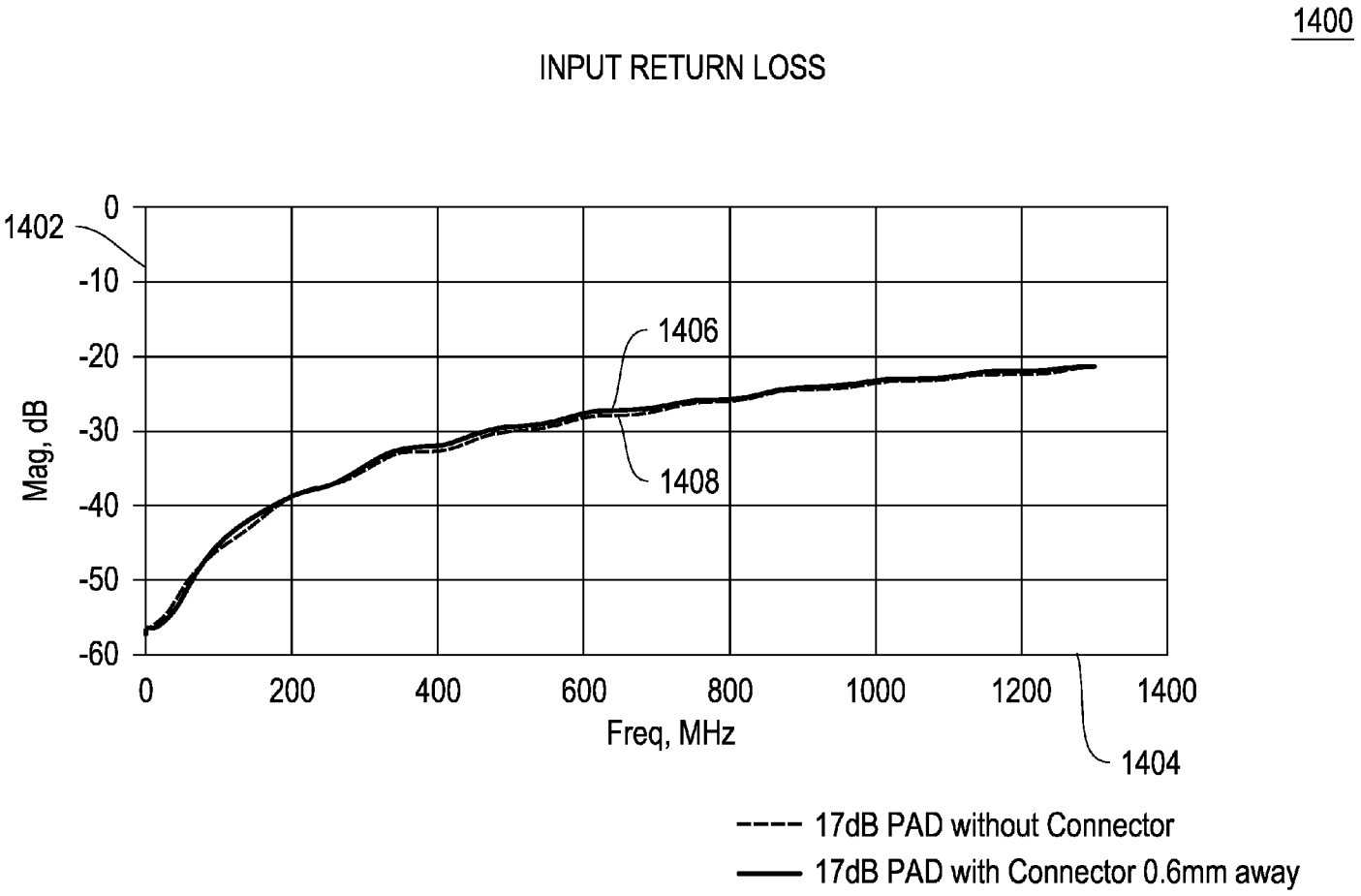

FIGS. 12, 13, and 14 provide further detail of the data provided in rows 1134 and 1136 in FIG. 11. FIG. 12 illustrates graph 1200, which is a plot of insertion loss for a system including a 17 dB pad attenuator. Graph 1200 includes vertical axis 1202, horizontal axis 1204, data line 1206 and data line 1208. Vertical axis 1202 corresponds to magnitude of attenuation, measured in decibels (dB). Horizontal axis 1204 corresponds to frequency of input signal, measured in megahertz (MHz). Both Data line 1206 and 1208 are plotted as a function of both vertical axis 1202 and horizontal axis 1204. Data line 1206 graphically represents data for a 17 dB pad attenuator being connected (by electrical contacts on the attenuator) to the ports on a PCB without a conductive connector being present. Data line 1208 graphically represents data for a 17 dB pad attenuator being connected (by electrical contacts on the attenuator) to the ports on a PCB while a metal conductive connector is held 0.6 mm away from the ports. The small difference (i.e., maximum −0.1 dB) between data lines 1206 and 1208 shows that the metal conductive connector introduces no negative stray capacitance or spurious inductance and does not negatively impact the performance (or has very little negative impact) of the system. The performance of the system, with respect to insertion loss, is advantageously (relatively) unchanged by the addition of the metal conductive connector.

FIG. 13 illustrates graph 1300, which is a plot of output return loss for a system including a 17 dB pad attenuator. Graph 1300 includes vertical axis 1302, horizontal axis 1304, data line 1306 and data line 1308. Vertical axis 1302 corresponds to magnitude of attenuation, measured in decibels (dB). Horizontal axis 1304 corresponds to frequency of input signal, measured in megahertz (MHz). Each of data lines 1306 and 1308 are plotted as a function of vertical axis 1302 and horizontal axis 1304. Data line 1308 graphically represents data for a 17 dB pad attenuator being connected (by electrical contacts on the attenuator) to the ports on a PCB without a conductive connector being present. Data line 1306 graphically represents data for a 17 dB pad attenuator being connected (by electrical contacts on the attenuator) to the ports on a PCB while a metal conductive connector is held 0.6 mm away from the ports. The small difference (i.e., maximum of less than −0.1 dB) between data lines 1306 and 1308 shows that the metal conductive connector introduces no negative stray capacitance or spurious inductance and does not negatively impact the performance (or has very little negative impact) of the system. The performance of the system, with respect to output return loss, is advantageously (relatively) unchanged by the addition of the metal conductive connector.

FIG. 14 illustrates graph 1400, which is a plot of input return loss for a system including a 17 dB pad attenuator. Graph 1400 includes vertical axis 1402, horizontal axis 1404, data line 1406 and data line 1408. Vertical axis 1402 corresponds to magnitude of attenuation, measured in decibels (dB). Horizontal axis 1404 corresponds to frequency of input signal, measured in megahertz (MHz). Each of data lines 1406 and 1408 are plotted as a function of vertical axis 1402 and horizontal axis 1404. Data line 1408 graphically represents data for a 17 dB pad attenuator being connected (by electrical contacts on the attenuator) to the ports on a PCB without a conductive connector being present. Data line 1406 graphically represents data for a 17 dB pad attenuator being connected (by electrical contacts on the attenuator) to the ports on a PCB while a metal conductive connector is held 0.6 mm away from the ports. The small difference (i.e., maximum of less than −0.1 dB) between data lines 1406 and 1408 shows that the metal conductive connector introduces no negative stray capacitance or spurious inductance and does not negatively impact the performance (or has very little negative impact) of the system. The performance of the system, with respect to input return loss, is advantageously (relatively) unchanged by the addition of the metal conductive connector.

Figure 15:
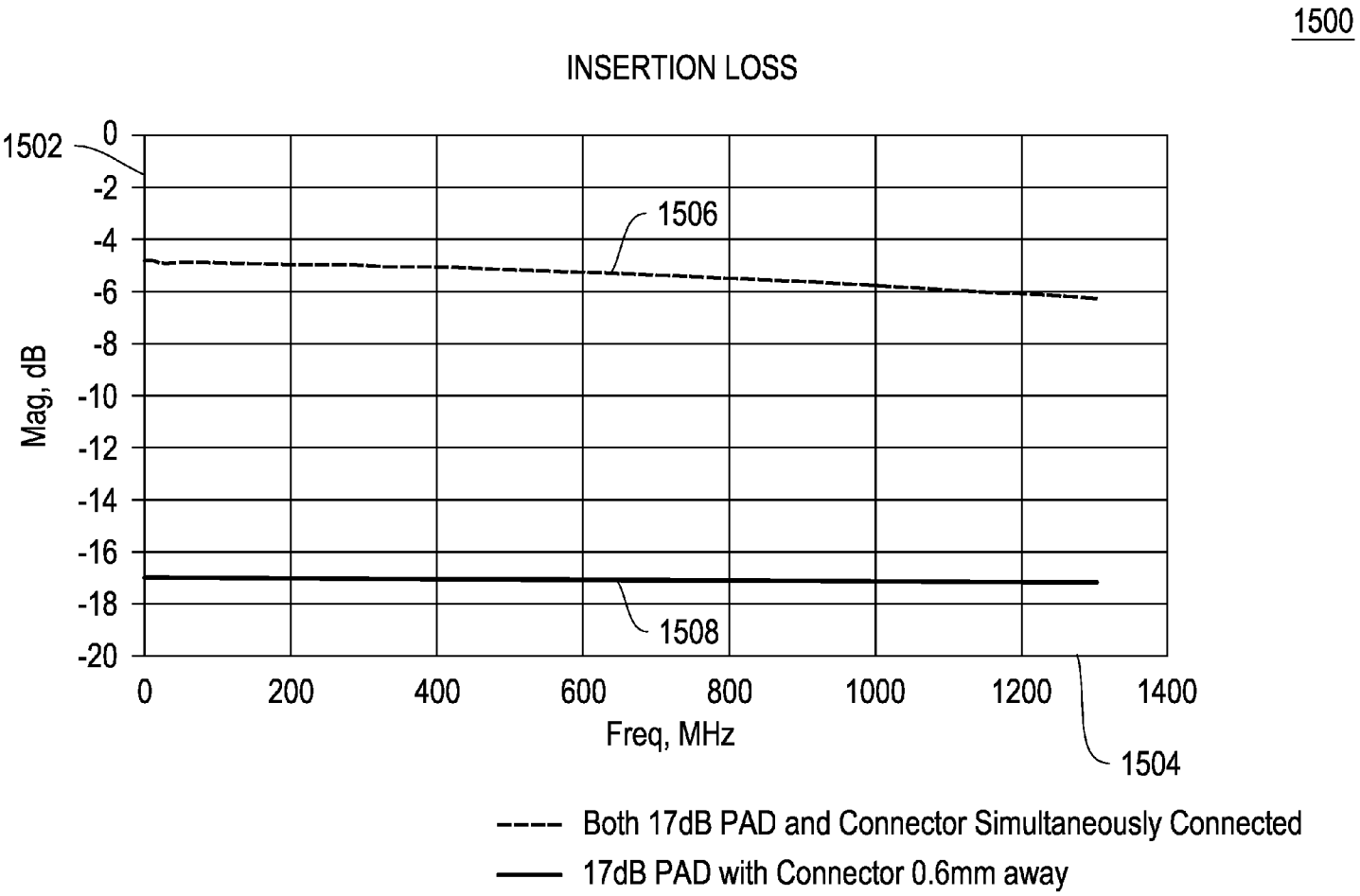

An electrical pathway is continuously available (i.e., seamless) during plugging in or plugging out the pad attenuator. At a point during the insertion or removal of the pad attenuator, both the electrical contact on the pad attenuator and the metal conductive connector are connected to the ports on the PCB board. At the aforementioned point, the insertion loss will result in a middle value. For example, FIG. 15 shows graph 1500 including data line 1506 and data line 1508. Data line 1506 corresponds to both a 17 dB pad attenuator and a conductive connector both being connected to the ports on a PCB (e.g., both plugged into the same port). In this case, the insertion loss ranges from about −5 dB to −6 dB. Data line 1506 corresponds to 17 dB pad attenuator being 0.6 mm away from the ports on the PCB. In this case, the insertion loss ranges is about −17 dB.

It is important to note that an electrical module, as disclosed herein may include any module suitable for connecting to the ports on a circuit board (e.g., via a guide device as disclosed herein). Some (non-limiting) examples of the electrical module include a module including an input pin and an output pin (for transferring input signals and output signals, respectively), an attenuator, a pad attenuator, an equalizer, an amplifier, any three-pin module, or any combination of the foregoing. An attenuator may be any suitable hardware (e.g., resistors) and/or logic for reducing the level of a signal (e.g., introducing losses in the transmission line on which the signal is carried). Some attenuators may acoustically reduce or pad down a signal (e.g., pad attenuators). In some examples, the electrical module is utilized in a CATV system to, at least in part, provide a CATV signal to one or more end users. The system and methods and methods described herein allow the CATV signal to the one or more end users to continue uninterrupted (e.g., to be "seamless") during a time in which the module has been removed (e.g., removed and replaced).

Additionally, it should be noted that with the examples provided above, interaction may be described in terms of two, three, or four components. However, this has been done for purposes of clarity and example only. In certain cases, it may be easier to describe one or more of the functionalities of a given set of flows by only referencing a limited number of network elements and/or physical components (e.g., flexural elements). It should be appreciated that the systems described herein are readily scalable and, further, can accommodate a large number of components, as well as more complicated/sophisticated arrangements and configurations. Accordingly, the examples provided should not limit the scope or inhibit the broad techniques of using flexural elements for providing a seamless (e.g., unbroken) electrical signal between electrical components, as potentially applied to a myriad of other architectures.

It is also important to note that the procedures in the methods described herein illustrate only some of the possible scenarios that may be executed by, or within, an apparatus (e.g., a guide device and/or system for providing seamless electrical signal between components) described herein. Some of these procedures may be deleted or removed where appropriate, or these procedures may be modified or changed considerably without departing from the scope of the present disclosure. In addition, a number of these operations have been described as being executed concurrently with, or in parallel to, one or more additional operations. However, the timing of these operations may be altered considerably. The preceding operational flows have been offered for purposes of example and discussion. The apparatus provides substantial flexibility in that any suitable arrangements, chronologies, configurations, and timing mechanisms may be provided without departing from the teachings of the present disclosure.

It should also be noted that many of the previous discussions may imply a single apparatus (e.g., a guide device comprising flexural elements as described herein). In reality, there is a multitude of apparatuses (and a multiple of flexural elements) in the delivery tier in certain implementations of the present disclosure. Moreover, the present disclosure can readily be extended to apply to intervening data centers, headends, further upstream in the architecture, though this is not necessarily correlated to 'm' client signals that are passing through a given headend. Any such permutations, scaling, and configurations are clearly within the broad scope of the present disclosure.

Numerous other changes, substitutions, variations, alterations, and modifications may be ascertained to one skilled in the art and it is intended that the present disclosure encompass all such changes, substitutions, variations, alterations, and modifications as falling within the scope of the appended claims. In order to assist the United States Patent and Trademark Office (USPTO) and, additionally, any readers of any patent issued on this application in interpreting the claims appended hereto, Applicant wishes to note that the Applicant: (a) does not intend any of the appended claims to invoke paragraph six (6) of 35 U.S.C. section 112 as it exists on the date of the filing hereof unless the words "means for" or "step for" are specifically used in the particular claims; and (b) does not intend, by any statement in the specification, to limit this disclosure in any way that is not otherwise reflected in the appended claims.

What is claimed is:

1. An apparatus comprising:

a support structure that, at least in part, borders a cavity in which to receive an electrical module;

at least one beam comprising:

a first end supported by the support structure and a second end;

a clip proximate the second end, wherein the clip is to retain a conductive connector;

a raised portion located between the first end and the second end and extended into the cavity, wherein the raised portion is to facilitate flexing the beam to disconnect an electrical contact between the conductive connector and a plurality of electrical contacts upon insertion of the electrical module into the cavity.

2. The apparatus of claim 1, wherein the raised portion facilitates the flexing of the beam to disconnect the electrical contact only after an electrical pin of the electrical module contacts one of the plurality of electrical contacts during the insertion.

3. The apparatus of claim 1, further comprising a guide device comprising a guide wall for securing to the circuit board, wherein the support structure is the guide wall.

4. The apparatus of claim 3, wherein the guide wall comprises a third end located proximate to a printed circuit board (PCB), a fourth end located distal to the PCB, and a medial end located between the third end and the fourth end, and wherein the first end is supported by the medial end of the guide wall.

5. The apparatus of claim 1, wherein the support structure is a portion of a printed circuit board (PCB).

6. The apparatus of claim 1, wherein the plurality of electrical contacts comprises an input contact and an output contact, and wherein the electrical contact between the conductive connector and the plurality of electrical contacts comprises the conductive connector being in electrical contact simultaneously with the input contact and the output contact.

7. The apparatus of claim 1, wherein the at least one beam is made from a plastic material, and wherein the conductive connector is made from an electrically conductive material.

8. The apparatus of claim 1, wherein the electrical module is a module comprising a plurality of pins for connecting to one or more of the plurality of electrical contacts.

9. An apparatus comprising:

a support structure that, at least in part, borders a cavity in which to receive an electrical module;

at least one beam comprising:

a first end supported by the support structure and a second end;

a clip proximate the second end, wherein the clip is to retain a conductive connector;

a raised portion located between the first end and the second end and extended into the cavity, wherein the raised portion is to facilitate unloading a force applied to the beam to establish an electrical contact between the conductive connector and a plurality of electrical contacts upon removal of the electrical module from the cavity.

10. The apparatus of claim 9, wherein the raised portion facilitates the unloading the force applied to the beam to establish the electrical contact before an electrical pin of the electrical module disconnects contact with one of the plurality of electrical contacts during the removal.

11. The apparatus of claim 9, further comprising a guide device comprising a guide wall for securing to the circuit board, wherein the support structure is the guide wall.

12. The apparatus of claim 11, wherein the guide wall comprises a third end located proximate to a printed circuit board (PCB), a fourth end located distal to the PCB, and a medial end located between the third end and the fourth end, and wherein the first end is supported by the medial end of the guide wall.

13. The apparatus of claim 9, wherein the support structure is a portion of a printed circuit board (PCB).

14. The apparatus of claim 9, wherein the plurality of electrical contacts comprises an input contact and an output contact, and wherein the electrical contact between the conductive connector and the plurality of electrical contacts comprises the conductive connector being in electrical contact simultaneously with the input contact and the output contact.

15. The apparatus of claim 9, wherein the at least one beam is made from a plastic material, and wherein the conductive connector is made from an electrically conductive material.

16. The apparatus of claim 9, wherein the electrical module is a module comprising a plurality of pins for connecting to one or more of the plurality of electrical contacts.

17. A system comprising:

a printed circuit board (PCB) comprising a plurality of electrical contacts;

a guide device to removably connect to the PCB, the guide device comprising a guide wall for securing to the printed circuit board and that, at least in part, borders a cavity in which to receive the electrical module;

an electrical module to removably insert into the cavity;

at least one beam comprising:

a first end supported by a support structure and a second end;

a clip proximate the second end, wherein the clip is to retain a conductive connector;

a raised portion located between the first end and the second end and extended into the cavity, wherein the raised portion is to facilitate flexing the beam to disconnect an electrical contact between the conductive connector and the plurality of electrical contacts upon insertion of the electrical module into the cavity, and wherein the raised portion is to facilitate unloading a force applied to the beam to establish the electrical contact between the conductive connector and the plurality of electrical contacts upon removal of the electrical module from the cavity.

18. The system of claim 17, wherein the raised portion facilitates the flexing of the beam to disconnect the electrical contact only after an electrical pin of the electrical module contacts one of the plurality of electrical contacts during the insertion, and wherein the raised portion facilitates the unloading the force applied to the beam to establish the electrical contact before an electrical pin of the electrical module disconnects contact with one of the plurality of electrical contacts during the removal.

19. The system of claim 17, wherein the support structure is the guide wall.

20. The system of claim 17, wherein the support structure is a portion of the PCB.

* * * * *